United States Patent [19]

Ohashi et al.

[11] Patent Number: 4,599,301

[45] Date of Patent: Jul. 8, 1986

[54] SILVER HALIDE COLOR PHOTOGRAPHIC MATERIAL

[75] Inventors: Yuichi Ohashi; Tadashi Ogawa, both of Kanagawa, Japan

[73] Assignee: Fuji Photo Film Co., Ltd., Kanagawa, Japan

[21] Appl. No.: 763,586

[22] Filed: Aug. 8, 1985

[30] Foreign Application Priority Data

Aug. 8, 1984 [JP] Japan ..... 59-164742

[51] Int. Cl.[4] ..... G03C 1/46; G03C 5/00; G03C 7/26; G03C 7/32

[52] U.S. Cl. ..... 430/505; 430/30; 430/543; 430/544; 430/957

[58] Field of Search ..... 430/505, 543, 544, 957, 430/30

[56] References Cited

U.S. PATENT DOCUMENTS

| | | | |
|---|---|---|---|
| 3,227,554 | 1/1966 | Barr et al. | 430/553 X |
| 4,040,829 | 8/1977 | Ohmatsu et al. | 430/505 |
| 4,306,015 | 12/1981 | Haylett | 430/544 X |
| 4,464,463 | 8/1984 | Kojima et al. | 430/544 X |
| 4,524,130 | 6/1985 | Iwasa et al. | 430/957 X |

FOREIGN PATENT DOCUMENTS 0114675 8/1984 European Pat. Off. .

*Primary Examiner*—John E. Kittle
*Assistant Examiner*—Mukund J. Shah
*Attorney, Agent, or Firm*—Sughrue, Mion, Zinn Macpeak & Seas

[57] ABSTRACT

A silver halide color photographic material is described, comprising a support having thereon at least a cyan-color-forming red-sensitive emulsion layer, a magenta-color-forming green-sensitive emulsion layer, and a yellow-color-forming blue-sensitive emulsion layer; the weight-averaged wavelength ($\bar{\lambda}$) on the spectral sensitivity distribution determined by equi-energy spectrum of said red-sensitive emulsion layer being less than 640 nm; the longest wavelength in the wavelengths having the sensitivity of ½ of the maximum value of the above-described equi-energy spectrum being in a range of from 30 nm to 55 nm longer than the weight-averaged wavelength and the minimum wavelength thereof being in a range of from 30 nm to 55 nm shorter than the weight-averaged wavelength; in the above-described equi-energy spectrum, values A and B defined below satisfying the relation of $A/B \geqq 0.91$; and further the sum of the interlayer effects on the red-sensitive emulsion layer from the green-sensitive emulsion layer and the blue-sensitive emulsion layer being more than 0.25

$$A = \int_{\lambda_1}^{\bar{\lambda}} S(\lambda)d\lambda$$

$$B = \int_{\bar{\lambda}}^{\lambda_2} S(\lambda)d\lambda$$

wherein, $S(\lambda)$ is the spectral sensitivity, $\lambda_1$ is the wavelength of the short wavelength end, and $\lambda_2$ is the wavelength of the long wavelength end.

16 Claims, 2 Drawing Figures

SILVER HALIDE COLOR PHOTOGRAPHIC MATERIAL

FIELD OF THE INVENTION

This invention relates to a silver halide multilayer color photographic material, and more particularly to a silver halide multilayer color photographic material capable of faithfully reproducing shades and purple forming red subjects during photographing, and having a high saturation color reproducibility.

BACKGROUND OF THE INVENTION

As is well known, a silver halide multilayer color photographic material has on a support such as a cellulose ester film or a polyester film, in succession, a red-sensitive silver halide emulsion layer containing a non-diffusible cyan image-forming coupler, a green-sensitive silver halide emulsion layer containing a non-diffusible magenta image-forming coupler, and a blue-sensitive silver halide emulsion layer containing a non-diffusible yellow image-forming coupler.

In the color negative photographing light-sensitive material having the above-described layer structure, the factors governing the color reproducibility are the following two factors.

One of the factors is an interlayer effect. In a silver halide multilayer color photographic material, it is known to add so-called DIR couplers which form or release a development inhibitor or a precursor thereof by causing a coupling reaction with the oxidation product of a color developing agent, and by inhibiting the occurrence of development of other silver halide emulsion layers with the development inhibitor released from the DIR compound, the interlayer effect is realized, whereby the effect of improving the color reproducibility is obtained.

Another factor is a spectral sensitivity distribution. In the layer structure of a silver halide multilayer color photographic material, it is usual that a red-sensitive emulsion layer has a sensitivity for light of wavelengths of from 550 to 680 nm, a green-sensitive emulsion layer for light of wavelengths of from 480 to 580 nm, and a blue-sensitive emulsion layer for light of wavelengths of from 400 to 510 nm. The color sensitivities of the emulsion layers are not always constant in each spectral wavelength region, each emulsion layer has a different spectral sensitivity distribution according to the spectral sensitizer(s) and other material(s), and the positions of the peaks of the spectral sensitivity distributions and the duplications of the foot portions thereof differ according to the selection or combination of the foregoing materials, which becomes another factor governing the color reproducibility of the color photographic material.

Recently, for color photographic materials, various improvements in DIR compounds and improvements in the techniques of using them have been made, and with such technical progress, a further improvements in color reproducibility has been investigated.

A method of adding DIR compounds for improving the color reproducibility of conventional color photographic materials is known, as described in U.S. Pat. No. 3,227,554, etc. It is generally known that a DIR compound gives an interlayer effect in multilayer color photographic materials, but the DIR compounds described in the above-described U.S. patent, etc., show only a small effect on improving the color reproducibility by the interlayer effect. If a large amount of such a DIR compound is used for improving the color reproducibility, there occurs such disadvantages that the development of the emulsion layer itself containing the compound is delayed, the gradation is lowered, and the maximum colored density and the effective sensitivity are lowered.

For eliminating the above-described disadvantages and improving the color reproducibility, a method of improving the color reproducibility by increasing the interlayer effect using diffusible DIR couplers is disclosed in Japanese Patent Application (OPI) No. 131934/84 (the term "OPI" as used herein refers to a "published unexamined Japanese patent application").

That is, Japanese Patent Application (OPI) No. 131934/84 discloses a silver halide color photographic material containing development inhibitor-releasing materials capable of releasing a development inhibitor having a magnitude of diffusibility of from 0.4 to 0.95 by causing a reaction with the oxidation product of a developing agent during development.

However, in the case of improving the color reproducibility of color photographic materials using the DIR couplers disclosed in the above patent application, the amount thereof may be small for obtaining a high-saturation color reproducibility, but the DIR couplers have a disadvantage that the reproduction of shades of photographic subjects, in particular, the reproduction shades of red subjects, is insufficient.

Also, a method is known for improving the saturation of a color photographic material by changing the spectral sensitivity distributions of the silver halide emulsion layers to reduce the duplication of the spectral sensitivity distributions of them, thereby improving the color separation, but this method has a disadvantage that the reproduction of the hue of an intermediate color is not faithful.

Thus, it has been desired to improve color photographic materials by eliminating these disadvantages.

SUMMARY OF THE INVENTION

One object of this invention is to provide a novel silver halide multilayer color photographic material without being accompanied by the above-described disadvantages.

Another object of this invention is to provide a silver halide photographic material which can faithfully reproduce a shade (in particular, red shade) of a photographing subject formed during photographing, the slight changes in hue of the object.

It has now been discovered that the above-described objects of this invention can be attained by the present invention as set forth hereinafter.

That is, according to this invention, there is provided a silver halide color photographic material comprising a support having thereon at least a cyan-color-forming red-sensitive emulsion layer, magenta-color-forming green-sensitive emulsion layer, and a yellow-color-forming blue-sensitive emulsion layer; the weight-averaged wavelength on the spectral sensitivity distribution determined by the equi-energy spectrum of said red-sensitive emulsion layer being less than 640 nm, preferably from 605 nm to 630 nm; the longest wavelength in the wavelengths having a sensitivity of ½ of the maximum value of the above-described equi-energy spectrum being in a range of from 30 nm to 55 nm longer than the weight-averaged wavelength and the minimum wavelength thereof being in a range of from 30 nm to 55 nm shorter than the weight-averaged wavelength; in the above-described equi-energy spectrum, values A and B defined below satisfying the relation of $A/B \geqq 0.91$, preferably $A/B \geqq 0.95$; and further the sum of the interlayer effect on the red-sensitive emulsion layer from the green-sensitive emulsion layer and the blue-sensitive emulsion layer being more than 0.25.

The weight-averaged wavelength λ and values A and B described above are represented by the equations $$\bar{\lambda} = \frac{\int_{\lambda_1}^{\lambda_2} \lambda S(\lambda) d\lambda}{\int_{\lambda_1}^{\lambda_2} \lambda S(\lambda) d\lambda}$$

$$A = \int_{\lambda_1}^{\bar{\lambda}} \lambda S(\lambda) d\lambda$$

$$B = \int_{\bar{\lambda}}^{\lambda_2} S(\lambda) d\lambda$$

wherein, $S(\lambda)$ is the spectral sensitivity $\lambda_1$ is the wavelength of the shorter wavelength end, and $\lambda_2$ is the wavelength of the longer wavelength end.

DESCRIPTION OF THE PREFERRED EMBODIMENT

Figure 1:
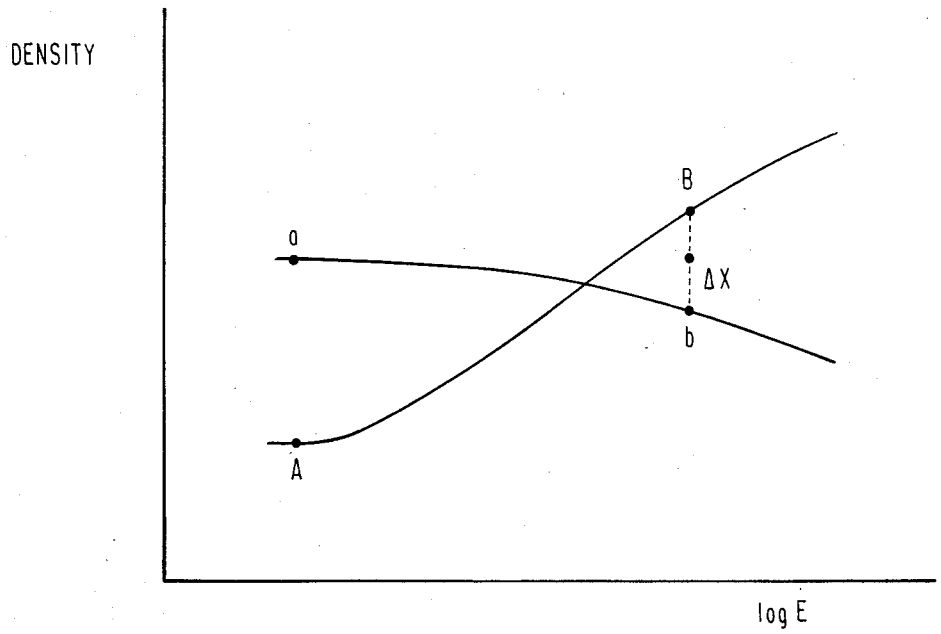
FIG. 1 is a conceptional graph showing a characteristic curve for obtaining Δx.

Now, the interlayer effects in this invention are as follows. That is, the interlayer effect on a red-sensitive emulsion layer from a green-sensitive emulsion layer is shown by difference (Δx in FIG. 1) between the cyan density at the point of giving magenta image density of 0.5 and the cyan density at the unexposed portion in the characteristic curve shown in FIG. 1 of the accompanying drawing obtained by first stepwise exposing a color photographic material to green light (using Fuji filter BPN-53, made by Fuji Photo Film Co., Ltd.) and then uniformly exposing the photographic material to red light (using Fuji filter SC 62). Interlayer effect on the red-sensitive emulsion layer from a blue-sensitive emulsion layer is similarly shown by the difference between both the cyan image densities as described above using, in this case, blue light (using Fuji filter BPN 43) for applying uniform exposure to the color photographic material after stepwise exposure.

For obtaining the interlayer effects as described above, any conventionally known method of obtaining an interlayer effect by increasing the amount of DIR compounds or the iodine content of silver halide emulsion layers may be used, but it is particularly preferred to use diffusible DIR compounds.

In this invention, it is preferred that a light-insensitive intermediate layer is disposed adjacent to a light-sensitive silver halide emulsion layer, and in this case, the interlayer may be disposed between two silver halide emulsions layers having a same color sensitivity but having different sensitivities.

It has been discovered that according to this invention, shades of photographic subjects, in particular the shades of red subjects can be faithfully reproduced and also a color reproduction of high saturation can be obtained.

In this invention, a red-sensitive emulsion layer can be provided with the above-described photosensitive spectral range (spectral sensitivity distribution) by properly combining known spectral sensitizing dyes.

The term "diffusible DIR compound" as used herein means a compound capable of forming a development inhibitor having large diffusibility during development and in this invention, DIR compounds capable of releasing a diffusible development inhibitor having the magnitude of the diffusibility of higher than 0.4 are preferred. Of these DIR compounds, DIR couplers are more preferred in this invention.

The magnitude of the diffusibility of a development inhibitor can be measured in the following manner.

A multilayer color photographic material (Sample B) is prepared by coating a transparent support, in succession, with the following layers.

(1) A red-sensitive silver halide emulsion layer formed by coating, at a coverage of 1.8 g/m$^2$ of silver (at a thickness of 2 microns), a gelatin solution containing a silver iodobromide emulsion (containing 5 mole% silver iodide and having a mean grain size of 0.4 micron) and 0.0015 mole of Coupler F shown below per mole of silver, and silver halide emulsion being imparted with red sensitivity using Sensitizing Dye I employed in Example 1 shown below.

Coupler F

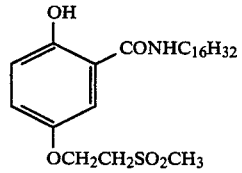

(2) A gelatin layer containing the silver iodobromide emulsion having the same composition as used in layer (1) but being not imparted with red sensitivity and polymethyl methacrylate particles (having diameters of about 1.5 microns) (at a coverage of 2 g/m$^2$ of silver and a thickness of 1.5 microns).

Each of these layers further contains a conventional gelatin hardener and surface active agent in addition to the above-described components.

Other color photographic material (Sample A) is also prepared in the same manner as Sample B, except that the silver iodobromide emulsion in layer (2) of Sample B is not used in layer (2) of Sample A.

Each of the samples thus prepared is subjected to a wedgewise exposure and then developed in the same manner as in Example 1 except that the development time is changed to 2 minutes and 10 seconds. On the other hand, each of different kinds of development inhibitors is added to the developer having the same composition as in Example 1 in such an amount that the image density of Sample A is reduced to one-half that obtained in the above experiment. Under the same conditions, Sample B is examined for magnitudes of reduction in image densities. Degrees of reduction of image densities in Sample B are used as a measure of the diffusibility of the development inhibitor in the silver halide emulsion layer.

The results thus obtained are set forth in Table 1 below.

TABLE 1

| Development Inhibitor | Diffusibility of Development Inhibitor: Addition Amount to Developing Solution | Reduction Rate of Image Density (%): Sample A | Reduction Rate of Image Density (%): Sample B | Diffusibility (= B/A) |
|---|---|---|---|---|
| 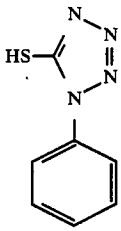 | $0.75 \times 10^{-4}$ M | 50 | 10 | 0.2 |
| 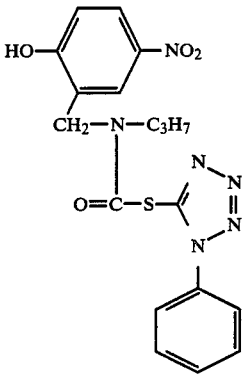 | $1 \times 10^{-4}$ | 50 | 25 | 0.5 |
| 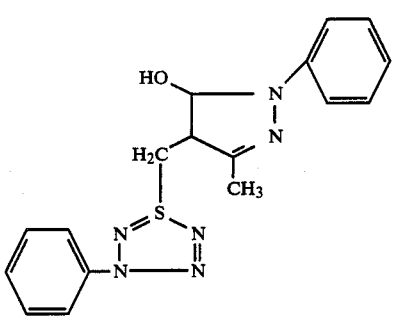 | $0.8 \times 10^{-4}$ | 48 | 20 | 0.42 |
| 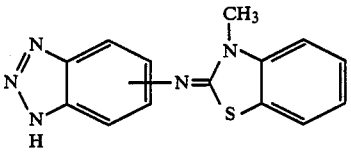 | $0.5 \times 10^{-4}$ | 50 | 15 | 0.3 |

TABLE 1-continued

| Diffusibility of Development Inhibitor | | | | |
|---|---|---|---|---|
| | | Reduction Rate of Image Density (%) | | |
| Development Inhibitor | Addition Amount to Developing Solution | Sample A | Sample B | Diffusibility (= B/A) |
| 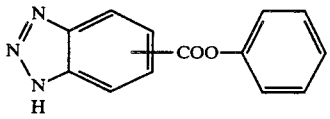 | $2 \times 10^{-4}$ | 52 | 37 | 0.74 |
| 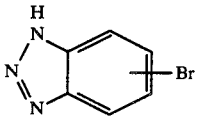 | $2.5 \times 10^{-4}$ | 51 | 45 | 0.9 |

The DIR couplers for use in this invention as described above are shown by formula (I)

$$A\text{—}Y)_m \quad \text{(I)}$$

wherein A represents a coupler moiety; m represents 1 or 2; and Y represents a group bonded with the coupling position of coupler moiety A and capable of being released by the reaction with the oxidation product of a color developing agent, said group shown by Y being a development inhibitor having large diffusibility or a group capable of releasing a development inhibitor.

In formula (I), Y can be represented by one of the following formulae (IIa) to (V)

(IIa)

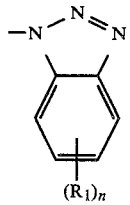

(IIb)

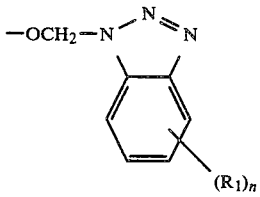

(III)

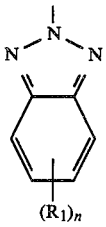

(IV)

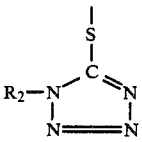

-continued (V)

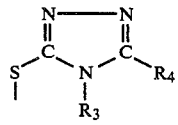

In formulae (IIa), (IIb) and (III), $R_1$ represents an alkyl group, an alkoxy group, an acylamino group, a halogen atom, an alkoxycarbonyl group, a thiazolylidene group, an acyloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a heterocyclic ring group, a cyano group, an alkylsulfonyl group, or an aryloxycarbonylamino group; n represents 1 or 2; when n is 2, said $R_1$s may be the same or different; and the total carbon atoms number contained in $nR_1$s is from 0 to 10.

In formula (IV), $R_2$ represents an alkyl group or a heterocyclic ring group.

In formula (V), $R_3$ represents a hydrogen atom, an alkyl group, an aryl group, or a heterocyclic ring group; and $R_4$ represents a hydrogen atom, an alkyl group, an aryl group, a halogen atom, an acylamino group, an alkoxycarbonylamino group, an aryloxycarbonylamino group, an alkanesulfonamido group, a cyano group, a heterocyclic ring group, an alkylthio group, or an amino group.

When $R_1$, $R_2$, $R_3$, or $R_4$ in the above-described formulae represents an alkyl group, the alkyl group may be a substituted or unsubstituted alkyl group, or a chain or cyclic alkyl group. The substituent includes a halogen atom, a nitro group, a cyano group, an aryl group, an alkoxy group, an aryloxy group, an alkoxycarbonyl group, an aryloxycarbonyl group, a sulfamoyl group, a carbamoyl group, a hydroxy group, an alkanesulfonyl group, an arylsulfonyl group, an alkylthio group, an arylthio group, etc.

When $R_1$, $R_2$, $R_3$ or $R_4$ represents an aryl group, the aryl group may have a substituent such as, for example, an alkyl group, an alkenyl group, an alkoxy group, an alkoxycarbonyl group, a halogen atom, a nitro group, an amino group, a sulfamoyl group, a hydroxy group, a carbamoyl group, an aryloxycarbonylamino group, an alkoxycarbonylamino group, an acylamino group, a cyano group, a ureido group, etc.

When $R_1$, $R_2$, $R_3$ or $R_4$ represents a heterocyclic ring group, the heterocyclic ring group represents a 5-membered or 6-membered single cyclic or condensed ring containing a nitrogen atom, an oxygen atom, or a sulfur atom as a hetero atom, and the heterocyclic ring groups include a pyridyl group, a quinolyl group, a furyl group, a benzothiazolyl group, an oxazolyl group, an imidazolyl group, a thiazolyl group, a triazolyl group, an imido group, an oxazine group, etc. These groups may be substituted by substituents as for the aryl group as described above.

In formula (IV), the number of carbon atom(s) contained in $R_2$ is from 1 to 15.

In general formula (V), the number of carbon atom(s) contained in $R_3$ and $R_4$ is from 1 to 15.

In general formula (I), Y can be also represented by formula (VI)

-TIME-INHIBIT (VI)

wherein, the TIME group is a group bonded to the coupling position of the coupler and capable of being cleaved by the reaction with the oxidation product of a color developing agent and also capable of releasing the INHIBIT group under controlled conditions. The INHIBIT group is a development inhibitor.

The above-described -TIME-INHIBIT group is preferably those shown by formulae (IV) to (XIII) as set forth below (also described in European Pat. No. 101,621).

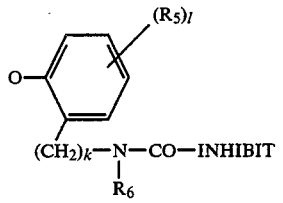
(VII)

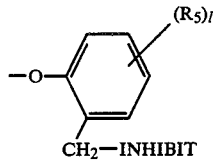
(VIII)

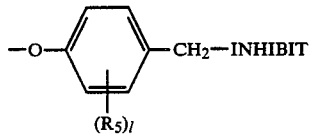
(IX)

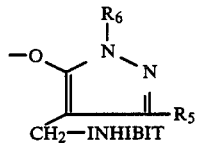
(X)

-continued

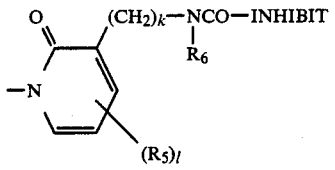
(XI)

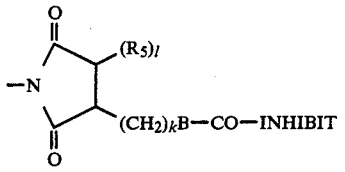
(XII)

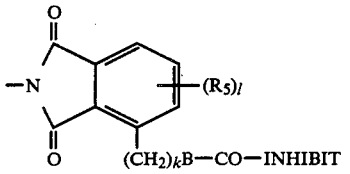
(XIII)

In formulae (VII) to (XIII), $R_5$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a hydroxy group, or an alkanesulfonyl group; in formulae (VII), (VIII), (IX), (XI) and (XIII), l represents 1 or 2; in formulae (VII), (XI), (XII) and (XIII), k represents 0, 1 or 2; in formulae (VII), (X) and (XI), $R_6$ represents an alkyl group, an alkenyl group, an aralkyl group, a cycloalkyl group or an aryl group; and in formulae (XII) and (XIII), B represents an oxygen atom or

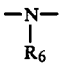

(wherein $R_6$ has the same meaning as defined above). The total number of carbon atoms contained in l $R_5$'s per molecule of formula (VII), (VIII), (IX), (X), (XI), (XII) or (XIII) is from 0 to 15. The number of carbon atoms contained in $R_6$ is from 1 to 15.

In the above-described diffusible DIR compounds, the compounds having a releasible group shown by formulae (IIa), (IIb) to (V) are particularly preferred.

The yellow image-forming coupler residue shown by A includes pivaloylacetanilide type, benzoylacetanilide type, malondiester type, malondiamido type, dibenzoylmethane type, malonestermonoamido type, benzothiazol acetate type, benzocazolylacetamido type, benzoxazolyl acetate type, benzimidazolylacetamido type, and benzimidazolyl acetate type coupler residues; coupler residues (groups) induced from heterocyclic ring-substituted acetamides or heterocyclic ring-substituted acetates described in U.S. Pat. No. 3,841,880; coupler residues induced from acrylacetamides described in U.S. Pat. No. 3,770,446; U.K. Pat. No. 1,459,171; West German Patent Application (OLS) No. 2,503,099; and Japanese Patent Application (OPI) No. 139738/75; and the heterocyclic type coupler residues described in U.S. Pat. No. 4,046,574.

Preferred examples of the magenta image-forming couplers residues shown by A are the coupler residues each containing a 5-oxo-2-pyrazoline, nucleus, a pyrazolo[1,5-a]benzimidazole nucleus, or a cyanoacetophenone nucleus.

Also, preferred examples of the cyan image-forming coupler residues shown by A are the coupler residues containing a phenol nucleus or an α-naphthol nucleus.

Furthermore, A in formula (I) is preferably those shown by formulae (IA), (IIA), (IIIA), (IVA), (VA), (VIA), (VIIA), (VIIIA), and (IXA) described in European Pat. No. 101,621 as described below.

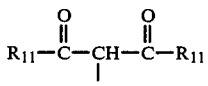
(IA)

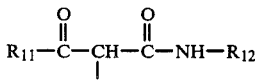
(IIA)

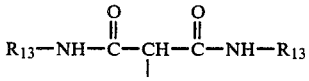
(IIIA)

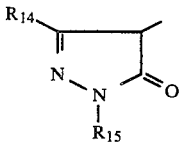
(IVA)

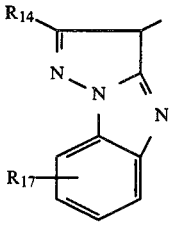
(VA)

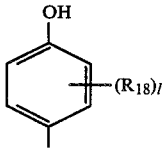
(VIA)

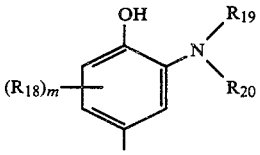
(VIIA)

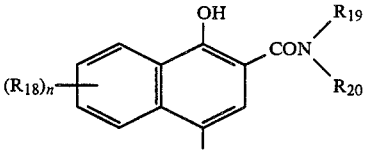
(VIIIA)

-continued

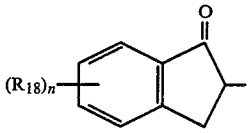
(IXA)

In the above-illustrated formulae, $R_{11}$ represents an aliphatic group, an aromatic group, an alkoxy group, or a heterocyclic group; and $R_{12}$ and $R_{13}$ each represents an aromatic group or a heterocyclic group.

Aliphatic groups represented by $R_{11}$ are preferably those containing from 1 to 22 carbon atoms, and may have substituents or not, and further, may have a chain form or a cyclic form. Preferable substituents therefor include an alkoxy group, an aryloxy group, an amino group, an acylamino group, a halogen atom and so on, which each may further have a substituent(s). Specific examples of aliphatic groups useful as $R_{11}$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group and the like.

In the case that $R_{11}$, $R_{12}$, or $R_{13}$ represents an aromatic group (especially a phenyl group), it may have a substituent. Such an aryl group as phenyl or the like may be substituted with a 32 or less carbon atoms containing alkyl, alkenyl, alkoxy, alkoxycarbonyl, alkoxycarbonylamino, aliphatic amido, alkylsulfamoyl, alkylsulfonamido, alkylureido, alkyl-substituted succinimido or like group. The alkyl group therein may include one which contains an aromatic group such as phenylene in its main chain. Further, a phenyl group represented by $R_{11}$, $R_{12}$, or $R_{13}$ may be substituted with an aryloxy group, an aryloxycarbonyl group, an arylcarbamoyl group, an arylamido group, an arylsulfamoyl group, an arylsulfonamido group, an arylureido group or the like, the aryl moiety of which groups each may be substituted with one or more alkyl groups, wherein the number of carbon atoms is 1 to 22 in total.

Furthermore, a phenyl group represented by $R_{11}$, $R_{12}$, $R_{13}$ may be substituted with an amino group which inclues one containing a lower ($C_1$ to $C_6$) alkyl group as a substituent, a hydroxy group, a carboxy group, a sulfo group, a nitro group, a cyano group, a thiocyano group, or a halogen atom.

In addition, $R_{11}$, $R_{12}$ or $R_{13}$ may represent a substituent formed by condensing a phenyl group and another ring, such as naphthyl, quinolyl, isoquinolyl, chromanyl, coumaranyl, tetrahydronaphthyl, or the like. These substituents may further have substituents on themselves.

In the case that $R_{11}$ represents an alkoxy group, the alkyl moiety thereof represents a $C_1$ to $C_{40}$ (i.e., containing from 1 to 40 carbon atoms), preferably $C_1$ to $C_{22}$, straight chain or branched chain alkyl, alkenyl, cycloalkyl or cycloalkenyl group, which each may be substituted with a halogen atom, an aryl group, an alkoxy group or so on.

In the case that $R_{11}$, $R_{12}$ or $R_{13}$ represents a heterocyclic group, the heterocyclic group is bonded to the carbon atom of the acyl moiety or the nitrogen atom of the amido moiety of an α-acylacetamido group through one of the carbon atoms forming the ring. Examples of such a heterocyclic ring include thiophene, furan, pyran, pyrrole, pyrazole, pyridine, pyrazine, pyrimidine, pyridazine, indolizine, imidazole, thiazole, oxazole, triazine, thiadiazine, oxazine and the like. These rings may further have substituents on the individual rings.

$R_{15}$ in formula (IVA) represents a $C_1$ to $C_{40}$, preferably $C_1$ to $C_{22}$, straight chain or branched chain alkyl (e.g., methyl, isopropyl, tert-butyl, hexyl, dodecyl, etc.), alkenyl (e.g., allyl, etc.), cyclic alkyl (e.g., cyclopentyl, cyclohexyl, norbornyl, etc.), aralkyl (e.g., benzyl, β-phenylethyl, etc.), cyclic alkenyl (e.g., chclopentenyl, cyclohexenyl, etc.), or the like, which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic ring residue, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group or so on.

$R_{15}$ in formula (IVA) may further represent an aryl group (e.g., phenyl, α- or β-naphthyl, etc.). The aryl group may have one or more substituents. Specific examples of such a substituent include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group and so on. Among the above-described substituents, more preferable for $R_{15}$ are phenyl groups which are substituted by an alkyl group, an alkoxy group, a halogen atom or the like at at least one of the o-positions, because they can contribute to reduction of photocoloration or thermocoloration of couplers remaining in film layers.

Furthermore, $R_{15}$ may represent a heterocyclic ring residue (e.g., a 5- or 6-membered heterocyclic one containing as a hetero atom a nitrogen atom, an oxygen atom, or a sulfur atom, or the condensed ring residues thereof, with specific examples including pyridyl, quinolyl, furyl, benzothiazolyl, oxazolyl, imidazolyl, naphthoxazolyl, etc.), a heterocyclic ring residue substituted with one of substituents set forth as examples for the above-described aryl group, an aliphatic or an aromatic acyl group, an alkylsulfonyl group, an arylsulfonyl group, an alkylcarbamoyl group, an arylcarbamoyl group, an alkylthiocarbamoyl group, or an arylthiocarbamoyl group.

$R_{14}$ in formula (IVA) or (VA) represents a hydrogen atom, a $C_1$ to $C_{40}$, preferably $C_1$ to $C_{22}$, straight chain or branched chain alkyl, alkenyl, cyclic alkyl, aralkyl or cyclic alkenyl group (which each may have one of the substituents set forth as examples for the above-described substituent $R_{15}$), an aryl group or a heterocyclic ring residue (which each also may have one of the substituents set forth as examples for the above-described substituent $R_{15}$), an alkoxycarbonyl group (e.g., methoxycarbonyl, ethoxycarbonyl, stearyloxycarbonyl, etc.), an aryloxycarbonyl group (e.g., phenoxycarbonyl, naphthoxycarbonyl, etc.), an aralkyloxycarbonyl group (e.g., benzyloxycarbonyl, etc.), an alkoxy group (e.g., methoxy, ethoxy, heptadecyloxy, etc.), an aryloxy group (e.g., phenoxy, tolyloxy, etc.), an alkylthio group (e.g., ethylthio, dodecylthio, etc.), an arylthio group (e.g., phenylthio, α-naphthylthio, etc.), a carboxy group, an acylamino group (e.g., acetylamino, 3-[(2,4-di-tert-amylphenoxy)acetamido]benzamido, etc.), a diacylamino group, an N-alkylacylamino group (e.g., N-methylpropionamido, etc.), an N-arylacylamino group (e.g., N-phenylacetamido, etc.), a ureido group (e.g., ureido, N-arylureido, N-alkylureido, etc.), a urethane group, a thiourethane group, an arylamino group (e.g., phenylamino, N-methylanilino, diphenylamino, N-acetylanilino, 2-chloro-5-tetradecanamidoanilino, etc.), an alkylamino group (e.g., n-butylamino, methylamino, cyclohexylamino, etc.), a cycloamino group (e.g., piperidino, pyrrolidino, etc.), a heterocyclic amino group (e.g., 4-pyridylamino, 2-benzoxazolylamino, etc.), an alkylcarbonyl group (e.g., methylcarbonyl, etc.), an arylcarbonyl group (e.g., phenylcarbonyl, etc.), a sulfonamido group (e.g., alkylsulfonamido, arylsulfonamido, etc.), a carbamoyl group (e.g., ethylcarbamoyl, dimethylcarbamoyl, N-methylphenylcarbamoyl, N-phenylcarbamoyl, etc.), a sulfamoyl group (e.g., N-alkylsulfamoyl, N,N-dialkylsulfamoyl, N-arylsulfamoyl, N-alkyl-N-arylsulfamoyl, N,N-diarylsulfamoyl, etc.), a cyano group, a hydroxy group, a mercapto group, a halogen atom or a sulfo group.

$R_{17}$ in formula (VA) represents a hydrogen atom, or a $C_1$ to $C_{32}$, preferably $C_1$ to $C_{22}$, straight chain or branched chain alkyl, alkenyl, cycloalkyl, aralkyl or cyclic alkenyl group, which each may have one of the substituents set forth as an example for the above-described substituent $R_{15}$.

Further, $R_{17}$ may represent an aryl group or a heterocyclic residue, which each may have one of the substituents set forth as examples for the above-described substituent $R_{15}$.

Furthermore, $R_{17}$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

Substituents $R_{18}$, $R_{19}$ and $R_{20}$ include groups which have been employed in conventional 4-equivalent type phenol or α-naphthol couplers. Specifically, substituent $R_{18}$ represents a hydrogen atom, a halogen atom, an aliphatic hydrocarbon residue, an acylamino group, an —O—$R_{21}$ group or an —S—$R_{21}$ group (wherein $R_{21}$ is an aliphatic hydrocarbon residue). When two or more of $R_{18}$'s are present in one molecule, they may be different from each other. The above-described aliphatic hydrocarbon residues include those having substituents. Substituents $R_{19}$ and $R_{20}$ include aliphatic hydrocarbon residues, aryl groups and heterocyclic ring residues. Either of them may be a hydrogen atom. The above-described substituents may further have certain substituents. Furthermore, $R_{19}$ and $R_{20}$ may combine with each other and form a nitrogen-containing heterocyclic nucleus. l represents an integer of 1 to 4, m represents an integer of 1 to 3, and n represents an integer of 1 to 5. More specifically, the above-described aliphatic hydrocarbon residues include both saturated and unsaturated ones, which each may have a straight chain form, a branched chain form or a cyclic form, with preferable examples including an alkyl group (e.g., methyl, ethyl, propyl, isopropyl, butyl, t-butyl, isobutyl, dodecyl, octadecyl, cyclobutyl, cyclohexyl, etc.) and an alkenyl group (e.g., allyl, octenyl, etc.). The above-described aryl group is a phenyl group, a naphthyl group or the like. Representatives of the above-described heterocyclic ring residues are pyridinyl, quinolyl, thienyl, piperidyl, imidazolyl and the like. These aliphatic hydrocarbon residues, aryl groups and hetero ring residues each may be substituted by a halogen atom, a nitro group, a hydroxy group, a carboxy group, an amino group, a substituted amino group, a sulfo group, an alkyl group, an alkenyl group, an aryl group, a heterocyclic ring residue, an alkoxy group, an aryloxy group, an arylthio group, an arylazo group, an acylamino group, a carbamoyl group, an ester residue, an acyl group, an acyloxy group, a sulfonamido group, a sulfamoyl group, a sulfonyl group, a morpholino group, etc.

Substituents $R_{11}$, $R_{12}$, $R_{13}$, $R_{14}$, $R_{15}$, $R_{16}$, $R_{17}$, $R_{18}$, $R_{19}$, and $R_{20}$ in the couplers represented by general formulae (IA) to (VIIIA) may combine with their respective corresponding substituents, or one of them may become a divalent group to form a symmeteric or an asymmeteric bis-type coupler.

Specific examples of the diffusible DIR couplers are shown below.

D-1

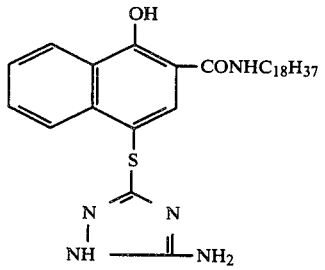

D-2

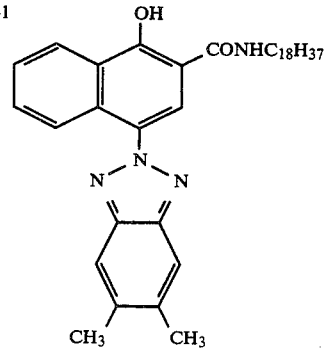

D-3

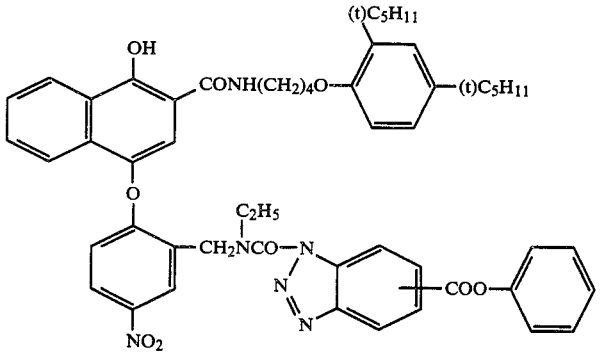

-continued
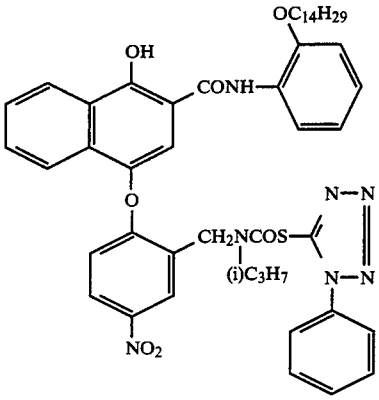
D-4
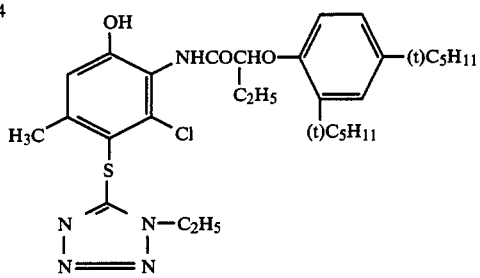
D-5
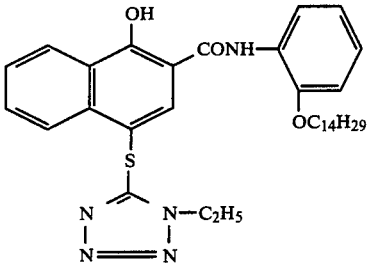
D-6
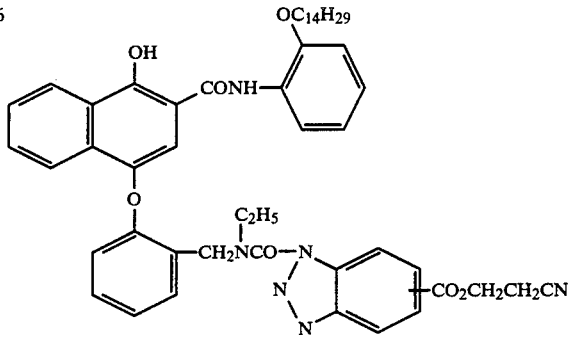
D-7
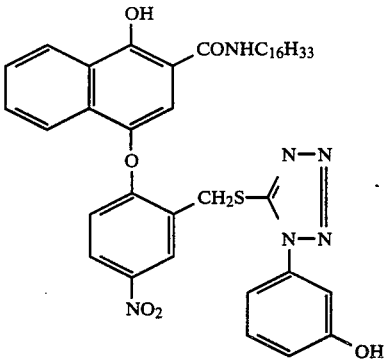
D-8
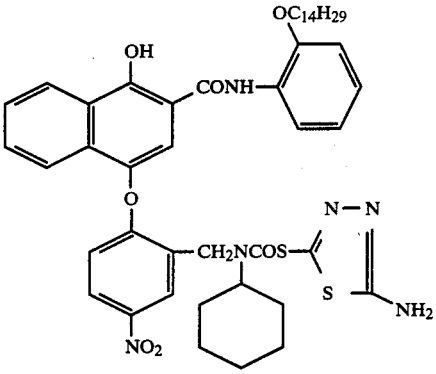
D-9
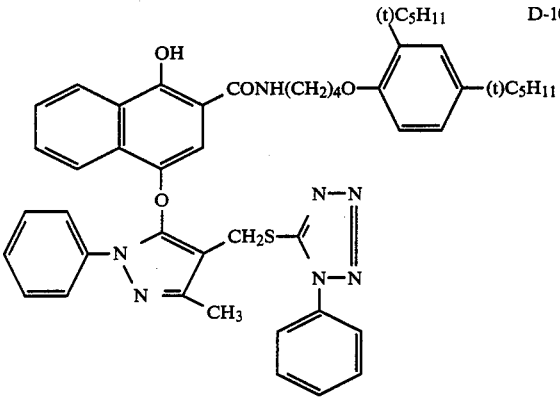
D-10
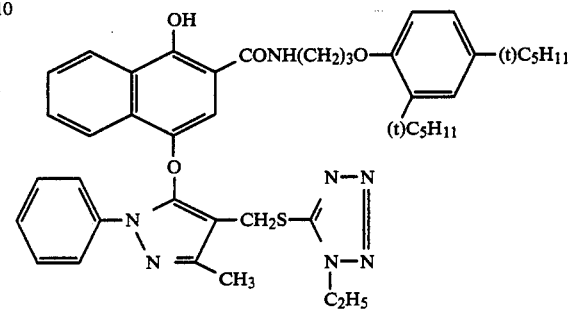
D-11

-continued
D-12
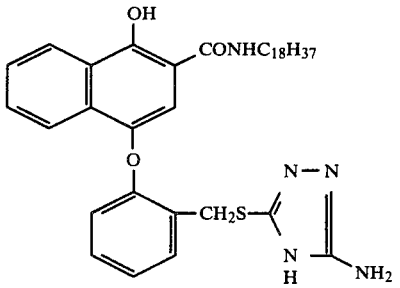
D-13
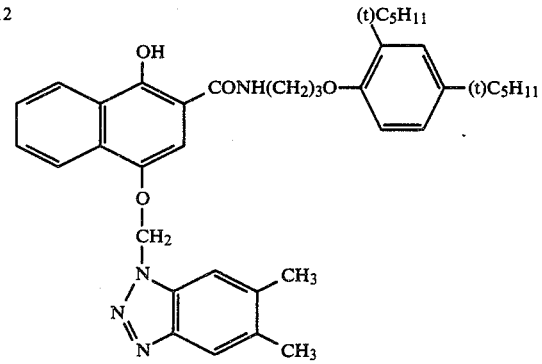
D-14
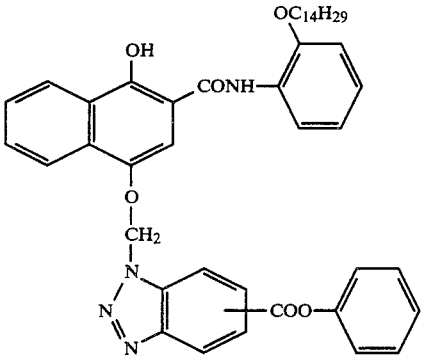
D-15
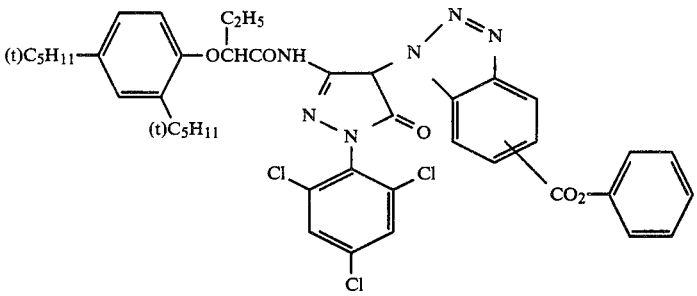
D-16
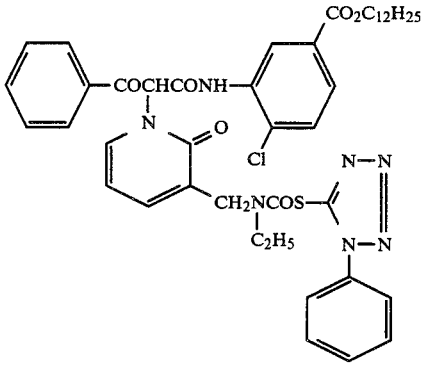
D-17
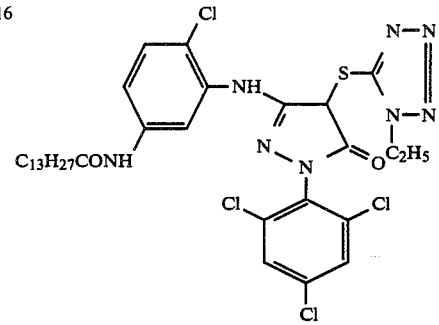
D-18
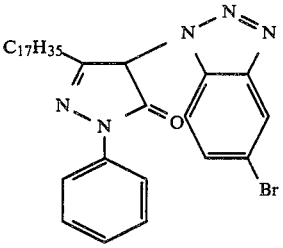
D-19
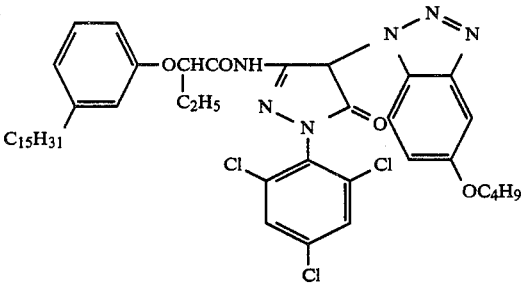

-continued
D-20
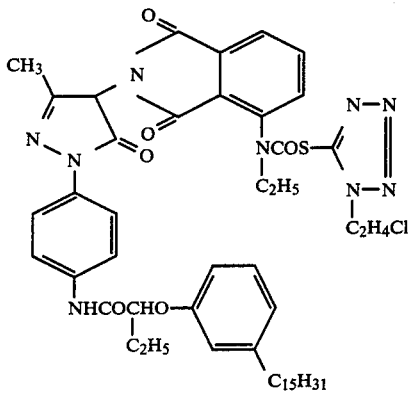
D-21
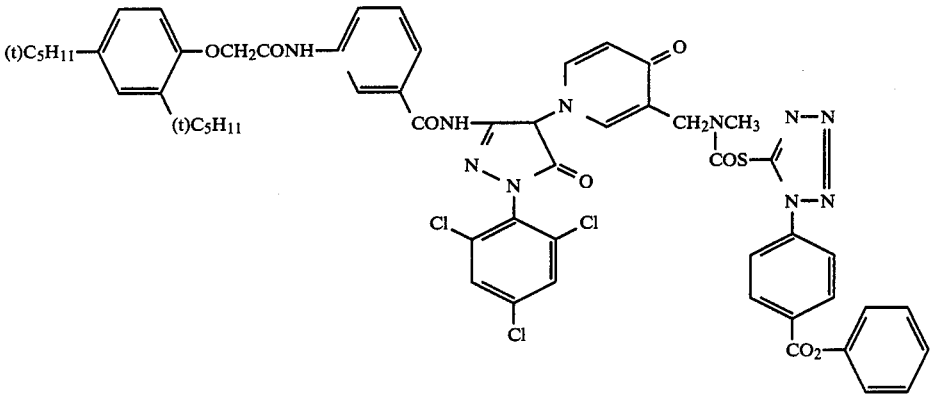
D-22
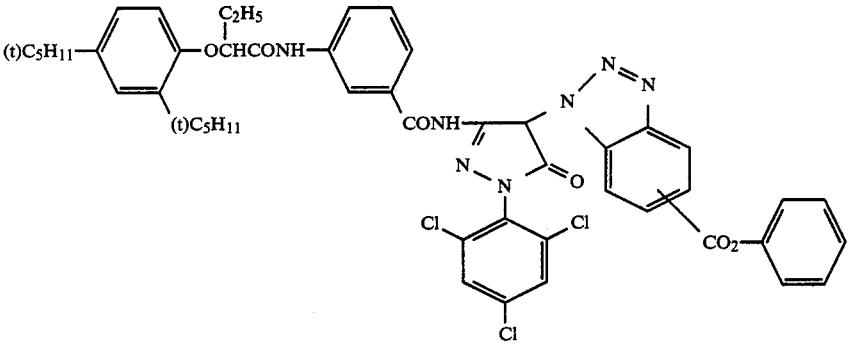
D-23
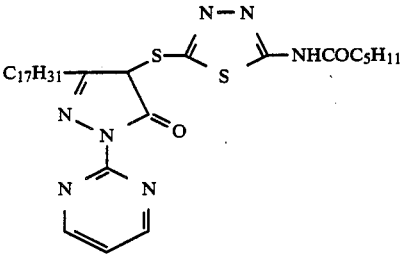
D-24
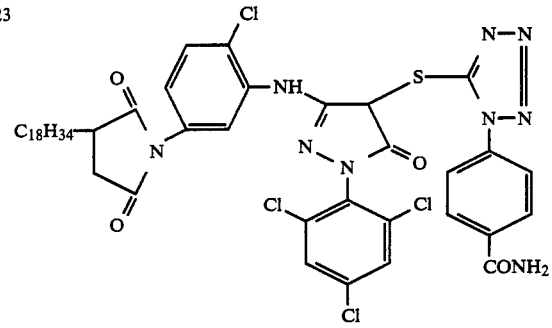

-continued
D-25
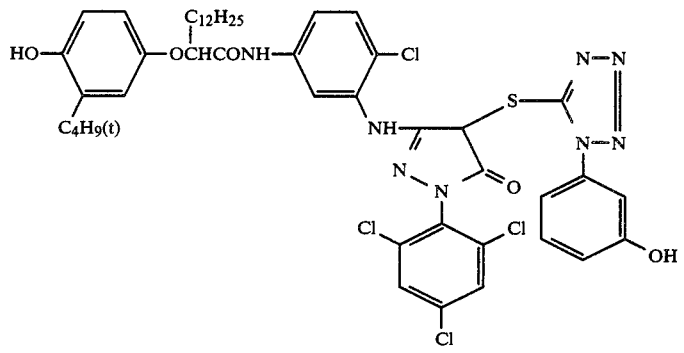
D-26
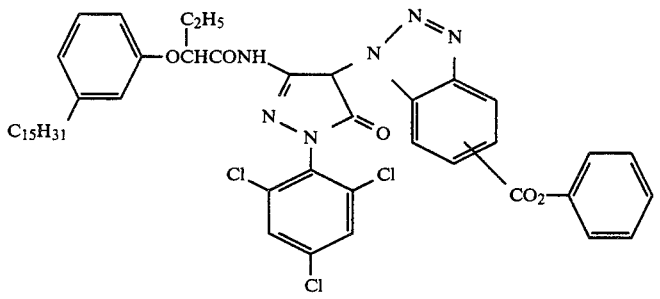
D-27
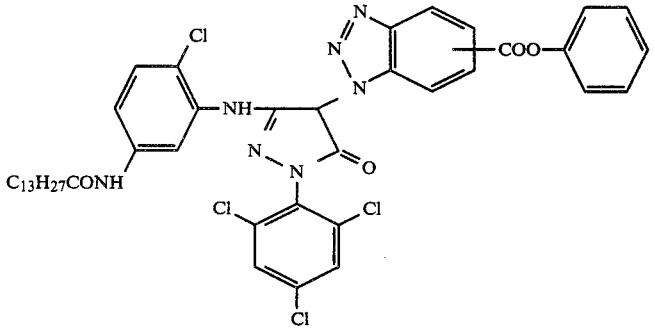
D-28
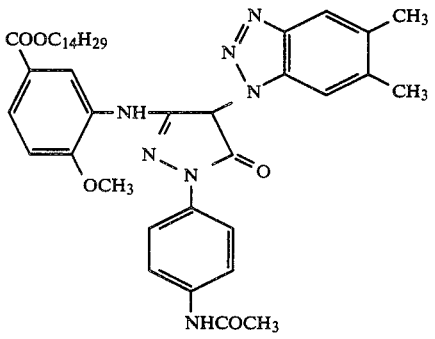

-continued
D-29
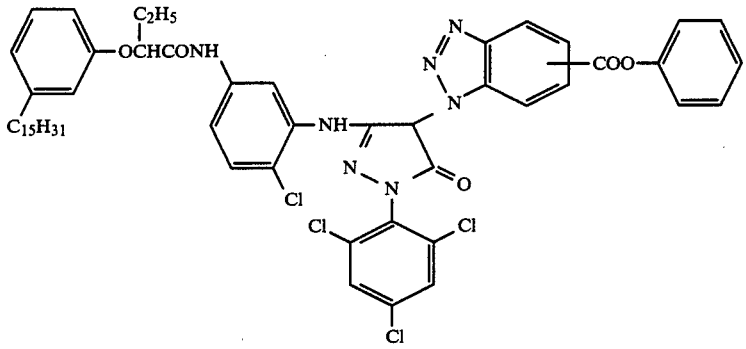
D-30
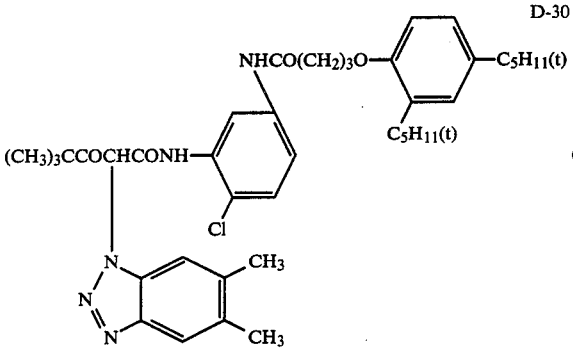
D-31
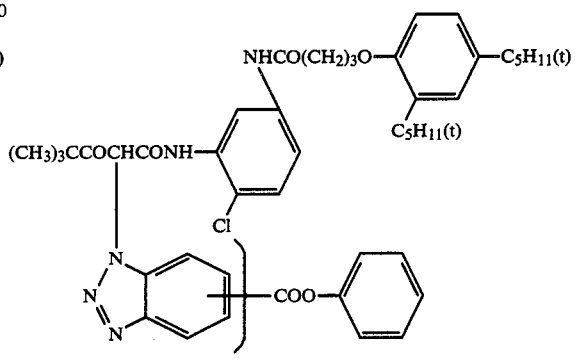
D-32
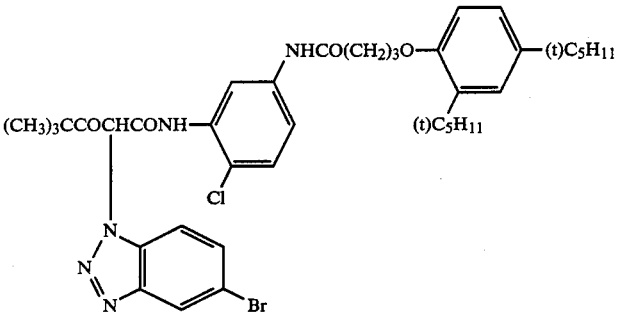
D-33
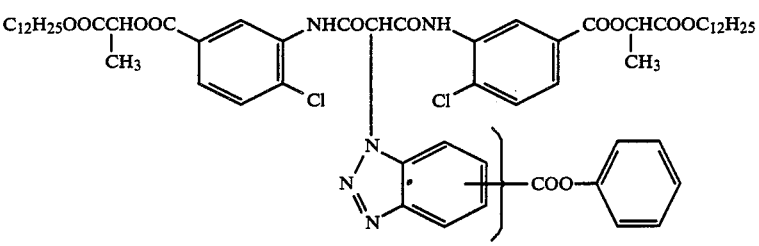
D-34
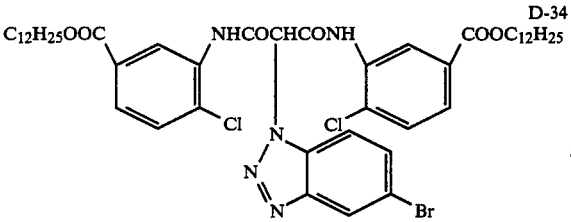
D-35
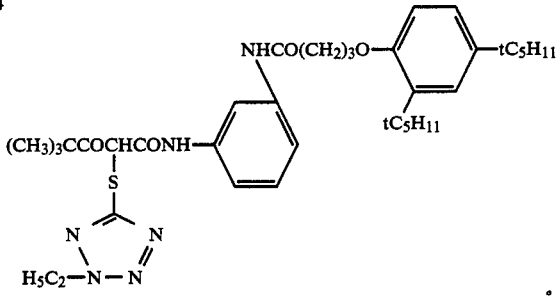

-continued
D-36
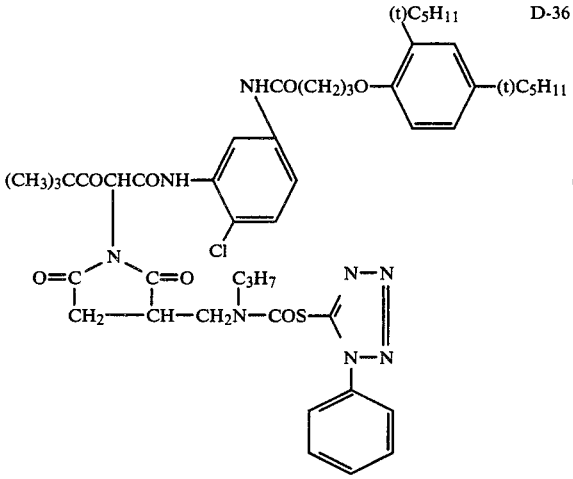
D-37
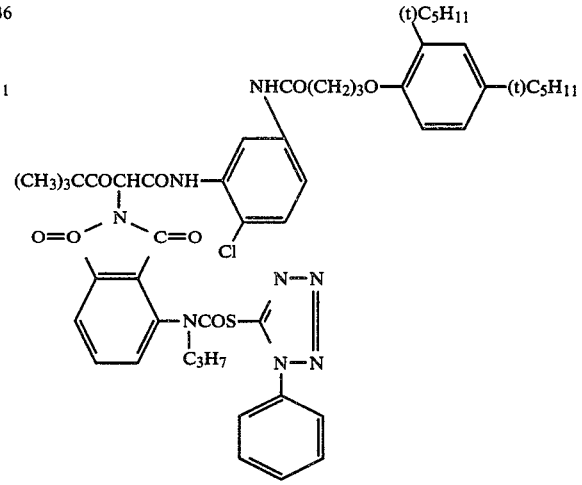
D-38
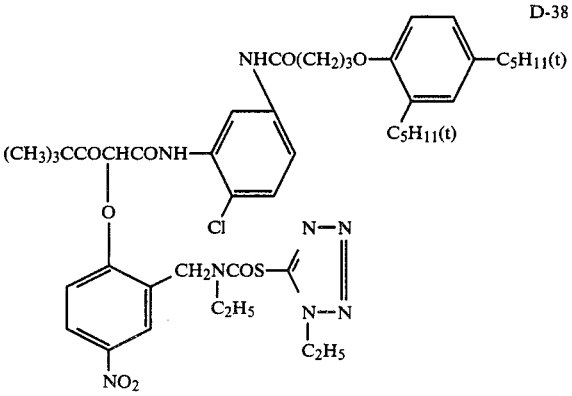
D-39
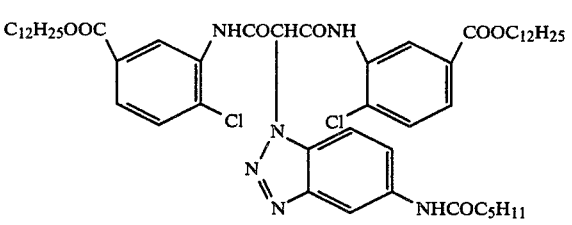
D-40
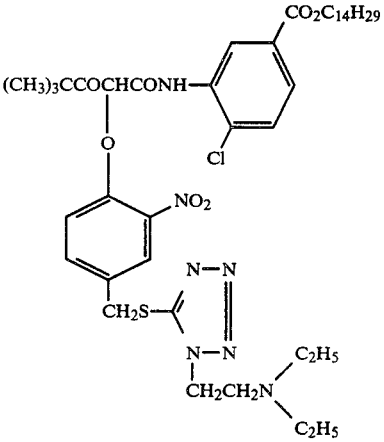
D-41
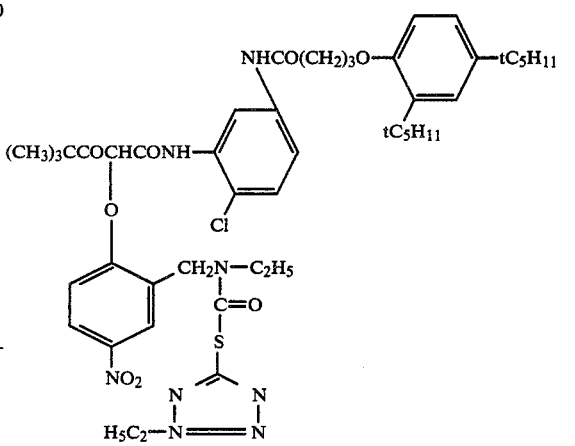
D-42
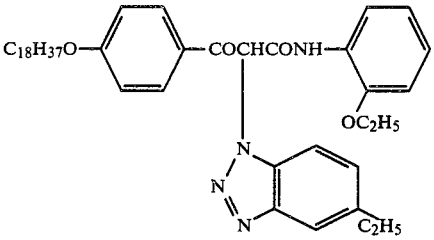
D-43
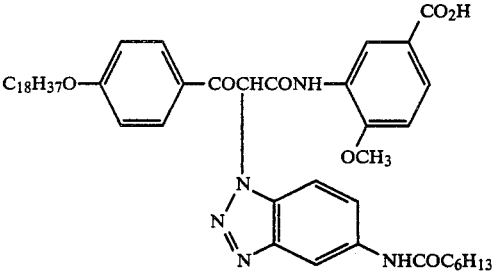

-continued

D-44

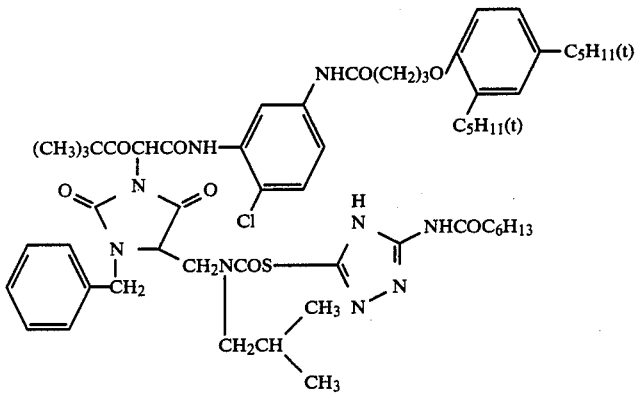

D-45

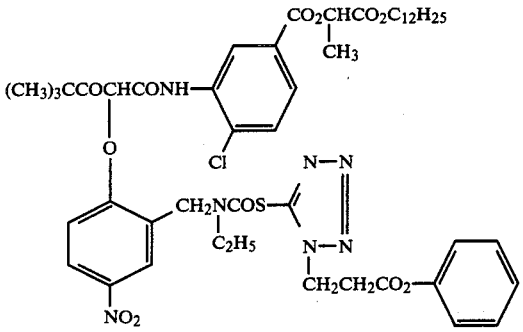

D-46

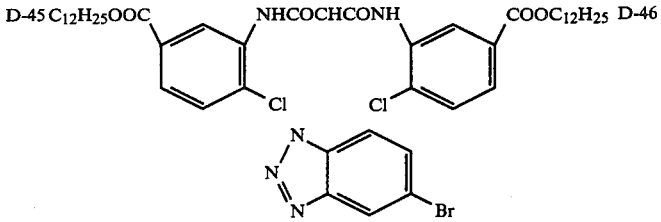

The above-described diffusible DIR compounds for use in this invention can be easily prepared by the methods described in U.S. Pat. Nos. 3,227,554, 3,617,291, 3,933,500, 3,958,993, 4,149,886, and 4,234,678; Japanese Patent Application (OPI) Nos. 13239/76 and 56837/82; U.K. Pat. Nos. 2,070,266; 2,072,363; and *Research Disclosure,* No. 212, RD No. 21228, December, 1981.

In this invention, a light-insensitive layer may or may not contain silver halide, without any influence on the effects of this invention.

When the light-insensitive layer contains a light-sensitive silver halide, it is preferred that the proportion of the DIR compound contained in the layer is generally higher than 50%, more preferably higher than 70%, still more preferably higher than 90% (most advantageously 100%) of the total molar amounts of the compounds capable of causing a coupling reaction with the oxidation product of a developing agent contained in the layer since thereby, the development of the light-sensitive silver halide in the layer is greatly inhibited, whereby the layer can be substantially said to be a light-insensitive layer.

The addition amount of the diffusible DIR compound is preferably from 0.00001 to 0.002 mole/$m^2$, and more preferably from 0.00002 to 0.001 mole/$m^2$.

The thickness of the light-insensitive layer is preferably from 0.1 to 5 $\mu$m, more preferably from 0.3 to 3 $\mu$m.

In this invention, the diffusible DIR compounds or other couplers as described hereinafter are incorporated in silver halide emulsion layers or light-insensitive layers by the method as described, for example, in U.S. Pat. No. 2,322,027.

For example, the aforesaid compound is dissolved in a high-boiling organic solvent such as a phthalic acid alkyl ester (e.g., dibutyl phthalate, dioctyl phthalate, etc.), a phosphoric acid ester (e.g., diphenyl phosphate, triphenyl phosphate, tricersyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, diethyl azerate, etc.), trimesic acid ester (e.g., tributyl trimesate, etc.), etc., or a low-boiling organic solvent having a boiling point of about 30° C. to 150° C., such as a lower alkyl acetate (e.g., ethyl acetate, ethyl propionate, etc.), sec-butyl alcohol, methyl siobutyl ketone, $\beta$-ethoxyethyl acetate, methyl cellosolve acetate, etc., and then dispersed in an aqueous solution of a hydrophilic colloid as the solution. The above-described high-boiling organic solvents and the low-boiling organic solvent may be used as a mixture thereof.

Also, the dispersion method by a polymer described in Japanese Patent Publication No. 39853/76 and Japanese Patent Application (OPI) No. 59943/76 can be used in this invention.

When the coupler has an acid group such as a carboxylic acid group or a sulfonic acid group, the coupler can be introduced into an aqueous solution of a hydrophilic colloid as an alkaline aqueous solution thereof.

As the binder or protective colloid which is used for the silver halide emulsion layer(s) and interlayer(s) of the photographic material of this invention, gelatin is advantageously used but other hydrophilic colloids can be also used.

Examples of these hydrophilic colloid are gelatin derivatives; graft polymers of gelatin and other macromolecular materials; proteins such as albumin, casein, etc.; cellulose derivatives such as hydroxyethyl cellulose, carboxymethyl cellulose, cellulose sulfate ester, etc.; sugar derivatives such as sodium alginate, starch derivatives, etc.; and various synthetic macromolecular materials as homopolymers or copolymers, such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

Examples of gelatin include limed gelatin as well as acid-processed gelatin and enzyme-processed gelatin as described in *Bull. Soc. Sci. Phot. Japan,* No. 16, page 30 (1966). In addition, hydrolyzed and enzyme decomposition products of gelatin can be used. Gelatin derivatives which can be used in this invention are those compounds as prepared by reacting gelatin with, for example, acid halides, acid anhydrides, isocyanates, bromoacetic acid, alkanesultones, vinylsulfonamide, maleinimide compounds, polyalkylene oxide, or epoxy compounds.

As the silver halide photographic emulsion layers of the photographic materials of this invention, silver bromide, silver iodobromide, silver iodochlorobromide, silver chlorobromide, or silver chloride may be used as the silver halide. A preferred silver halide is silver iodobromide containing 15 mole% or less silver iodide. A particularly preferred silver halide in this invention is silver iodobromide containing 2 mole% to 12 mole% silver iodide.

There is no particular restriction on the mean grain size (shown by the diameter of grains when the silver halide grains are spherical grains or grains similar to spherical, or shown by the mean value based on the projection areas using the side length as the grain size when the silver halide grains are cubic grains) of the silver halide grains in the silver halide photographic emulsion layer.

The grain sizes of the silver halide grains for use in this invention may be narrow or broad.

The silver halide grains in the photographic emulsion layers in this invention may have a regular crystal form such as a cubic form, an octahedron, etc., or an irregular crystal form such as a spherical form, a tabular form, etc., or may a composite form of such crystal forms. They may be also composed of a mixture of silver halide grains of various crystal forms.

A silver halide emulsion wherein "tabular" silver halide grains, i.e., having the diameter of more than 5 times the thickness thereof occupy 50% or more of the total injection areas can be used in this invention.

The silver halide grains for use in this invention may have a layer structure having different phase between the inside thereof and the surface layer thereof or may have a homogeneous phase structure. Also, the silver halide grains may be of a type of mainly forming a latent image at the surface thereof or of a type of mainly forming a latent image in the inside.

The silver halide photographic emulsions for use in this invention can be prepared by the methods described in P. Glafkides, *Chimie et Physique Photographique* (published by Paul Montel, 1967), G. F. Duffin, *Photographic Emulsion Chemistry* (published by The Focal Press, 1966), V. L. Zelikman et al, *Making and Coating Photographic Emulsion* (published by The Focal Press, 1964), etc. That is, the photographic emulsions may be prepared by an acid process, a neutralization process, an ammonia process, etc., and the reaction of a soluble silver salt and a soluble halide may be performed by a single jet method, a double jet method, or a combination of them.

A so-called back mixing method of forming silver halide grains in the presence of excessive silver ion can be used. Also, as one system of the double jet method, a so-called controlled double jet method of maintaining pAg at a constant value in a liquid phase for forming the silver halide grains can be used.

According to the aforesaid method, a silver halide emulsion containing silver halide grains having a regular crystal form and uniform grain size distribution is obtained.

Silver halide grains may be formed or physically ripened in the presence of a cadmium salt, a zinc salt, a thallium salt, an iridium salt or a complex salt thereof, a rhodium salt or a complex salt thereof, or an iron salt or a complex salt thereof.

After the formation of precipitates or physical ripening, soluble salts are usually removed from the silver halide emulsion thus obtained and the removal of the soluble salts may be performed by a well-known noodle method which is performed after gelling gelatin of the emulsion or a flucculation method utilizing an inorganic salt composed of a polyvalent anion, an anionic surface active agent such as sodium sulfate, an anionic polymer such as polystyrenesulfonic acid, a gelatin derivative (e.g., aliphatic acylated gelatin, aromatic acylated gelatin, aromatic carbamoylated gelatin), etc.

Silver halide emulsions for use in this invention are usually chemically sensitized. For the chemical sensitization may be used the method described, for example, in H. Frieser, *Die Grundlagender Photographischen Prozesse mit Silver Halogeniden* (published by Akademisch Verlagsgesellschaft, 1968), pages 675–735.

Examples include a sulfur sensitization method using active gelatin or a sulfur-containing compound capable of reacting with silver (e.g., a thiosulfate, a thiourea, a mercapto compound, a rhodanine, etc.,); a reduction sensitization method using a reducing material (e.g., a stannous salt, an amine, a hydrazine derivative, formamidinesulfinic acid, a silane compound, etc.); and a noble metal sensitizing method using a noble metal compound (e.g., a metal complex salt or complex salts of metals belonging to group VIII of the periodic table, such as Pt, Ir, Pd, etc.). These sensitizing methods may be used individually or as a combination of them.

The silver halide photographic emulsions for use in this invention may further contain various compounds for preventing the formation of fog during the production, storage or processing of photographic materials or stabilizing the photographic performance of the photographic materials. These compounds are fogging agents or stabilizers, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptothiadiazoles, aminotriazoles, benzotriazoles, nitrobenztriazoles, mercaptotetrazoles (in particular, 1-phenyl-5-mercaptotetrazole), etc.; mercaptopyrimidines; mercaptotriazines; thioketo compounds such as oxadolinethion, etc.; azaindenes such as triazaindenes, tetraazaindenes (in particular, 4-hydroxy-substituted (1,3,3a,7)tetraazaindenes), pentaazaindenes, etc.; benzenethiosulfonic acid; benzenesulfinic acid; benzeensulfonic acid amide, etc.

The photographic materials of this invention may further contain, in the silver halide photographic emulsion layers or other hydrophilic colloid layers, various surface active agents for coating aid, static prevention, the improvement of slidability, the improvement of dispersibility, sticking prevention, the improvement of photographic characters (e.g., development acceleration, increase of contrast, increase of sensitivity, etc.), etc.

Examples of the surface active agents are nonionic surface active agents such as saponin (steroid series), alkylene oxide derivatives (e.g., polyethylene glycol, polyethylene glycol/polyporpylene glycol condensation products, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide addition products of silicone, etc.), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents having an acid group such as a carboxy group, a sulfo group, a phospho group, a sulfuric acid ester group, a phosphoric acid ester group, etc., (e.g., alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaines, amine oxides, etc.); and cationic surface active agents such as aromatic quaternary ammonium salts, heterocyclic quaternary ammonium salts (e.g., pyridinium, imidazolium, etc.), phosphonium or sulfonium salts containing an aliphatic ring or heterocyclic ring, etc.

The photographic materials of this invention may further contain in the photographic emulsion layers polyalkylene oxide or the derivatives thereof such as the ethers, esters, amines, etc.; thioether compounds; thiomorpholines; quaternary ammonium salt compounds, urethane derivatives; urea derivatives; imidazole derivatives; 3-pyrazolidones, etc., for increasing sensitivity, increasing contrast, or accelerating development.

Also, the photographic materials of this invention may further contain in the photographic emulsion layers and other hydrophilic colloid layers dispersions of water-insoluble or water sparingly soluble polymers for improving the dimensional stability. Examples of these polymers are polymers of monomers such as alkyl(meth)acrylate, alkoxyalkyl(meth)acrylate, glycidyl(meth)acrylate, (meth)acrylamide, vinylesters (e.g., vinyl acetate), acrylonitrile, olefin, styrene, etc., solely or as a combination thereof, or a combination of the aforesaid monomer and acrylic acid, methacrylic acid, $\alpha,\beta$-unsaturated dicarboxylic acid, hydroxyalkyl(meth)acrylate, sulfoalkyl(meth)acrylate, styrenesulfonic acid, etc.

The photographic materials of this invention can be processed using the known processes and processing solutions, as described, for example, in *Research Disclosure,* No. 176, pages 28–30 (December, 1978). The photographic process may be color photographic process for forming dye images.

The processing temperature is usually selected between 18° C. and 50° C., but may be lower than 18° C. or over 50° C. In a specific mode of development process, a process of performing the development by processing the photographic material containing a developing agent, for example, in the photographic emulsion layer, in an alkaline aqueous solution may be used.

In this case, a hydrophobic developing agent may be incorporated in a photographic emulsion layer by methods as described in *Research Disclosure,* No. 169-16928 (May, 1978); U.S. Pat. No. 2,739,890; U.K. Pat. No. 813,253; West German Pat. No. 1,547,763, etc. Such a development process may be combined with a silver salt stabilizing process by a thiocyanate.

A fix solution having a conventional composition may be used. Examples of the fixing agent are thiosulfates, thiocyanates, as well as organic sulfur compounds which are known to have an effect as a fixing agent. The fix solution may contain a water-soluble aluminum as a hardening agent.

Dye images may be formed by an ordinary process, such as, for example, a nega-posi process as described in, for example, *Journal of the Society of Motion Picture and Television Engineers,* Vol. 61, 667–701(1953).

A color developer for developing the photographic material of this invention is usually composed of an alkaline aqueous solution containing a color developing agent. Examples of the color developing agent are primary aromatic amine developing agents such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline, etc.).

Other color developing agents are described, for example, in L. F. A. Mason, *Photographic Processing Chemistry,* pages 226–229 (published by The Focal Press, 1966; U.S. Pat. Nos. 2,193,015, and 2,592,364; and Japanese Patent Application (OPI) No. 64,933/73.

The color developers may further contain pH buffers such as the sulfites, carbonates, borates and phosphates of alkali metals or developing inhibitors or antifoggants such as bromides, iodides, and organic antifoggants. Also, if desired, the color developers may contain water hardeners, preservatives such as hydroxylamine, etc., organic solvents such as benzyl alcohol, diethylene glycol, etc., development accelerators such as polyethylene glycol, quaternary ammonium salts, amines, etc., dye-forming couplers, competing couplers, fogging agent such as sodium boron hydride, etc., auxiliary developing agents such as 1-phenyl-3-pyrazolidone, etc., tackifiers, polycarboxylic acid series chelating agents, antioxidants, etc.

The photographic materials of this invention are usually subjected to bleach processing after color development. The bleach process may be performed simultaneously with fix processing or separately from fix processing. Examples of bleaching agent include compounds of polyvalent metals such as iron(III), cobalt(III), chromium(VI), copper(II), etc., peracids, quinones, nitroso compounds, etc. Further examples of the bleaching agent are ferricyanides, bichromates, organic complex salts of iron(III) or cobalt(III), aminopolycarboxylic acids (e.g., ethylenediaminetetraacetic acid, nitrilotriacetic acid, 1,3-diamino-2-propanoltetraacetic acid, etc.,), complex salts of organic acids such as citric acid, tartaric acid, malic acid, etc., persulfates, permanganates, nitrosophenol, etc. In these compounds, potassium ferricyanide, ethylenediaminetetraacetic acid iron(III) sodium, and ethylenediaminetetraacetic acid iron(III) ammonium are particularly advantageous.

Ethylenediaminetetraacetic acid iron(III) complex salts are useful for both the individual bleach solution and the monobath-type blix solution.

The bleach solution or blix solution may further contain the bleach accelerators described in U.S. Pat. Nos. 3,042,520 and 3,241,966, Japanese Patent Publication Nos. 8506/70, 8836/70, etc., the thiol compounds described in Japanese Patent Application (OPI) No. 65732/78, and various other additives.

The silver halide photographic emulsions for use in this invention may be spectrally sensitized by methine dyes or other dyes. Examples of the dyes for the spectral sensitization are cyanine dyes, merocyanine dyes, complex cyanine dyes, complex merocyanine dyes, holopolar cyanine dyes, hemicyanine dyes, styryl dyes, hemioxonol dyes, etc. Particularly useful dyes are cyanine dyes, merocyanine dyes, and complex merocyanine dyes.

For these dyes may be used nucleus as usually utilized for cyanine dyes as the basic heterocyclic ring thereof. Examples of these nuclei include pyrroline nuclei, oxazoline nuclei, oxazole nuclei, thiazole nuclei, selenazole nuclei, imidazole nuclei, tetrazole nuclei, pyridine nuclei, etc.; nuclei formed by fusing an alicyclic hydrocarbon ring to these nuclei,; and nuclei formed by fusing an aromatic hydrocarbon ring to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted onto carbon atoms.

For the merocyanine dyes or complex merocyanine dyes may be applied 5- or 6-membered heterocyclic nuclei such as pyrazolin-5-one nuclei, thiohydantoin nuclei, 2-thiooxazolidine-2,4-dione nuclei; thiazolidine-2,4-dione nuclei, rhodanine nuclei, thiobarbituric acid nuclei, etc., as the nuclei having a ketomethylene structure.

Examples of the useful sensitizing dyes are described, for example, in German Pat. No. 929,080; U.S. Pat. Nos. 2,231,658, 2,493,748, 2,503,776, 2,519,001, 2,912,329, 3,656,959, 3,672,897, 3,694,217, 4,025,349, and 4,046,572, U.K. Pat. No. 1,242,588; Japanese Patent Publication Nos. 14030/69 and 24844/77, etc.

These sensitizing dyes may be used singly or as a mixture thereof. The combination of sensitizing dyes is frequently used for the purpose of supersensitization.

Specific examples of these combinations for use in this invention are described, for example, in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, and 3,837,862, 4,026,707; U.K. Pat. Nos. 1,344,281 and 1,507,803; Japanese Patent Publication Nos. 4936/68 and 12375/78; Japanese Patent Application (OPI) Nos. 110618/77 and 109925/77, etc.

The silver halide photographic emulsions for use in this invention may further contain dye having spectral sensitizing action by itself or a material which does not substantially absorb visible light and shows a supersensitization.

This invention is applicable to a multilayer multicolor photographic material having at least two photographic emulsion layers each having different spectral sensitivity, on a support. A multilayer natural color photographic material usually has on a support at least one red-sensitive emulsion layer, at least one green-sensitive emulsion layer and at least one blue-sensitive emulsion layer. The disposition order of these emulsion layers may be optionally changed as desired. The red-sensitive emulsion layer usually contains a cyan-forming coupler, the green-sensitive emulsion layer contains a magenta-forming coupler, and the blue-sensitive emulsion contains a yellow-forming coupler, but other combinations may be employed if desired.

The photographic material of this invention may further contain in the silver halide photographic emulsion layers or light-insensitive layers dye-forming couplers, that is, the compounds capable of coloring by oxidative coupling with an aromatic primary amine developing agent (e.g., a phenylenediamine derivative, an aminophenol derivative, etc.,) in color development process. Examples of these compounds are 5-pyrazolone couplers, pyrazolonebenzimidazole couplers, pyrazolonetriazole couplers, cyanoacetylcumarone couplers, open chain acylacetonitrile couplers, etc., as magenta couplers; acylacetamido couplers (benzoylacetanilides, pivaloylacetanilides, etc.,), etc., as yellow couplers; and naphthol couplers, phenol couplers, etc., as cyan couplers. These couplers are preferably non-diffusible couplers having a hydrophobic group called as ballast group in the molecule or polymerized couplers. These couplers may be of two equivalent or four equivalent to silver ion. Also, these couplers may be colored couplers having a color correction effect or so-called DIR couplers capable of releasing a development inhibitor with the progress of development.

Also, the photographic emulsions may further contain non-coloring DIR coupling compounds which form a colorless DIR coupling compound which forms a colorless coupling reaction product and releases a development inhibitor.

Moreover, the photographic materials of this invention may further contain compounds capable of releasing a development inhibitor with development in place of the DIR couplers.

Two or more kinds of the aforesaid couplers may be used for a same photographic emulsion layer for satisfying desired characteristics required for the photographic materials or a same coupler may be incorporated in two or more layers.

It is convenient to select the photographic color couplers for giving intermediate scale images. That is, it is preferred that the maximum absorption band of the cyan dye formed from a cyan coupler is between about 600 to about 720 nm, the maximum absorption band of a magenta dye formed from a magenta coupler is between about 500 to about 580 nm, and the maximum absorption band of a yellow dye formed from a yellow coupler is between from about 400 to about 480 nm.

The photographic materials of this invention may further contain in the photographic emulsion layers and other hydrophilic colloid layers inorganic or organic hardening agents such as chromium salts (e.g., chromium alum, chromium acetate, etc.), aldehydes (e.g., formaldehyde, glyoxale, glutar aldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They may be used solely or as a combination thereof.

When dyes or ultraviolet absorbents, etc., are incorporated in the hydrophilic colloid layers of the photographic materials of this invention, they may be mordanted by cationic polymers, etc.

The photographic materials of this invention may further contain color fogging preventing agents such as hydroquinone derivatives, aminophenol derivatives, gallic acid derivatives, ascorbic acid derivatives, etc. Specific examples thereof are described, for example, in U.S. Pat. Nos. 2,360,290, 2,336,327, 2,403,721, 2,418,613, 2,675,314, 2,701,197, 2,704,713, 2,728,659, 2,732,300, and 2,735,765; Japanese Patent Application (OPI) Nos. 92988/75, 92989/75, 93928/75, 110337/75, and 146235/77; Japanese Patent Publication No. 23813/77, etc.

The photographic materials of this invention may further contain ultraviolet absorbents in the hydrophilic colloid layers. Examples of the ultraviolet absorbents are aryl-substituted benzotriazole compounds (as described, for example, in U.S. Pat. No. 3,533,794), 4-thiazolidone compounds (as described, for example, in U.S. Pat. Nos. 3,314,794, 3,352,681, etc.), benzophenone compounds (as described, for example, in Japanese Patent Application (OPI) No. 2784/71), cinnamic acid ester compounds (as described, for example, in U.S. Pat. Nos. 3,705,805, 2,707,375, etc.), butadiene compounds (as described, for example, in U.S. Pat. No. 4,045,229), and benzoxidol compounds (as described, for example, in U.S. Pat. No. 3,700,455). Furthermore, the materials described in U.S. Pat. No. 3,499,762 and Japanese Patent Application (OPI) No. 48535/79 can also used. Also, ultraviolet absorptive couplers (e.g., α-naphtholic cyan dye-forming couplers) and ultraviolet absorptive polymers may be used as the ultraviolet absorbents. These ultraviolet absorbents may be mordanted to the layers. The photographic materials of this invention may further contain in the hydrophilic colloid layers water-soluble dyes as filter dyes or irradiation prevention and other various purposes. Examples of these dyes include oxonol dyes, hemioxonol dyes, styryl dyes, merocyanine dyes, cyanine dyes, and azo dyes. In these dyes, oxonol dyes, jemioxonol dyes and merocyanine dyes are useful.

In the practice of this invention, the following fading preventing agents may be used together, and also dye image stabilizers may be used singly or as a combination thereof in this invention. Examples of fading preventing agents include hydroquinone derivatives, gallic acid derivatives, p-alkoxyphenols, p-oxyphenols, and bisphenols.

Specific examples of the hydroquinone derivatives are described in U.S. Pat. Nos. 2,360,290, 2,418,613, 2,675,314, 2,701,197, 2,704,713, 2,728,659, 2,732,300, 2,735,765, 2,710,801, and 3,816,028; and U.K. Pat. No. 1,363,921. Examples of the gallic acid derivatives are described in U.S. Pat. Nos. 3,457,079, 3,069,262, etc. Examples of the p-alkoxyphenols are described in U.S. Pat. Nos. 2,735,765 and 3,698,909; Japanese Patent Publication Nos. 20977/74 and 6623/77, etc. Examples of the p-oxyphenol derivatives are described in U.S. Pat. Nos. 3,432,300, 3,573,050, 3,574,627, and 3,764,377; Japanese Patent Application (OPI) Nos. 35633/77; 147434/77 and 152225/77, etc. Examples of the bisphenols are described in U.S. Pat. No. 3,700,455, etc.

Then, the present invention will be explained in detail with reference to the following example, but the invention should not be construded as being limited thereto.

EXAMPLE

A multilayer color photographic material was prepared by forming the following layers on a cellulose triacetate film support.

Layer 1: Antihalation Layer:

A layer composed of 1.5 g/m$^2$ of gelatin containing block colloid silver.

Layer 2: Intermediate Layer

A layer composed of 1.2 g/m$^2$ of gelatin containing an emulsified dispersion of 2,5-di-t-octylhydroquinone.

Layer 3: First Red-Sensitive Emulsion Layer:

Silver Iodobromide Emulsion

| | |
|---|---|
| Silver Iodide: | 6 mole % |
| Mean Grain Size: | 0.5 μm |
| Silver Coverage: | 2.0 g/m$^2$ |
| Gelatin Coverage: | 3.5 g/m$^2$ |
| Sensitizing Dye I: | $1.4 \times 10^{-4}$ mole per mole of Ag |
| Sensitizing Dye II: | $1.5 \times 10^{-5}$ mole per mole of Ag |
| Sensitizing Dye III: | $2.5 \times 10^{-4}$ mole per mole of Ag |
| Coupler EX-1: | 0.04 mole per mole of Ag |

-continued

| | |
|---|---|
| Coupler EX-3: | 0.003 mole per mole of Ag |
| Coupler D-33: | 0.0015 mole per mole of Ag |

Layer 4: Second Red-Sensitive Emulsion Layer;

Silver Iodobromide Emulsion

| | |
|---|---|
| Silver Iodide: | 8 mole % |
| Mean Grain Size: | 0.8 μm |
| Silver Coverage: | 0.9 g/m$^2$ |
| Gelatin Coverage: | 1.1 g/m$^2$ |
| Sensitizing Dye I: | $1.2 \times 10^{-4}$ mole per mole of Ag |
| Sensitizing Dye II: | $1.5 \times 10^{-5}$ mole per mole of Ag |
| Sensitizing Dye III: | $2.2 \times 10^{-4}$ mole per mole of Ag |
| Coupler EX-2: | 0.02 mole per mole of Ag |
| Coupler EX-3: | 0.0016 mole per mole of Ag |

Layer 5: Intermediate Layer

Same as Layer 2.

Layer 6: First Green-Sensitive Emulsion Layer:

Silver Iodobromide Emulsion Layer

| | |
|---|---|
| Silver Iodide: | 6 mole % |
| Mean Grain Size: | 0.4 μm |
| Silver Coverage: | 1.5 g/m$^2$ |
| Gelatin Coverage: | 1.5 g/m$^2$ |
| Sensitizing Dye IV: | $3 \times 10^{-4}$ mole per mole of Ag |
| Sensitizing Dye V: | $1.5 \times 10^{-4}$ mole per mole of Ag |
| Coupler EX-4: | 0.05 mole per mole of Ag |
| Coupler EX-6: | 0.008 mole per mole of Ag |
| Coupler D-33: | 0.003 mole per mole of Ag |

Layer 7: Second Green-Sensitive Emulsion Layer:

| | |
|---|---|
| Silver Iodide: | 7 mole % |
| Mean Grain Size: | 0.7 μm |
| Silver Coverage: | 1.3 g/m$^2$ |
| Gelatin Coverage: | 1.6 g/m$^2$ |
| Sensitizing Dye IV: | $1.8 \times 10^{-4}$ mole per mole of Ag |
| Sensitizing Dye V: | $9.0 \times 10^{-5}$ mole per mole of Ag |
| Coupler EX-4: | 0.017 mole per mole of Ag |

-continued

| | |
|---|---|
| Coupler EX-5: | 0.003 mole per mole of Ag |
| Coupler EX-6: | 0.003 mole per mole of Ag |

Layer 8: Yellow Filter Layer:

A layer composed of 1.5 g/m$^2$ of gelatin containing emulsified dispersion of yellow colloid silver and 2,5-di-t-octylhydroquinone in aqueous gelatin solution.

Layer 9: First Blue-Sensitive Emulsion Layer:

Silver Iodobromide Emulsion

| | |
|---|---|
| Silver Iodide: | 6 mole % |
| Mean Grain Size: | 0.3 μm |
| Silver Coverage: | 0.7 g/m$^2$ |
| Gelatin Coverage: | 1.2 g/m$^2$ |
| Coupler EX-7: | 0.25 mole per mole of Ag |
| Coupler D-33: | 0.015 mole per mole of Ag |

Layer 10: Second Blue-Sensitive Emulsion Layer:

Silver Iodobromide Emulsion

| | |
|---|---|
| Silver Iodide: | 6 mole % |
| Mean Grain Size: | 0.7 μm |
| Silver Coverage: | 0.6 g/m$^2$ |
| Gelatin Coverage: | 1.0 g/m$^2$ |
| Coupler EX-7: | 0.06 mole per mole of Ag |

Layer 11: Protective Layer:

A layer composed of 1.0 g/m$^2$ of gelatin containing polymethyl methacrylate particles (diameter of about 1.5 μm).

To each of the above layers was added Gelatin Hardener H-1 and a surface active agent in addition to the above-described components.

Thus, Sample 101 was prepared.

The materials used for the above-described photographic material were as follows.

EX-1

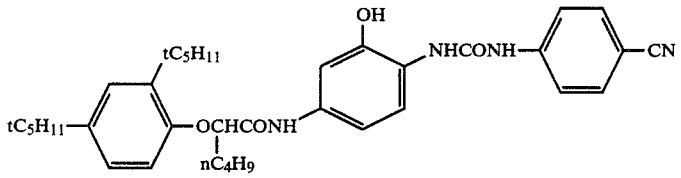

EX-2

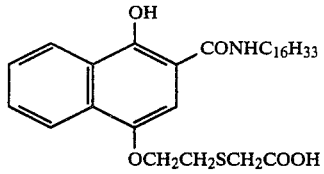

EX-3

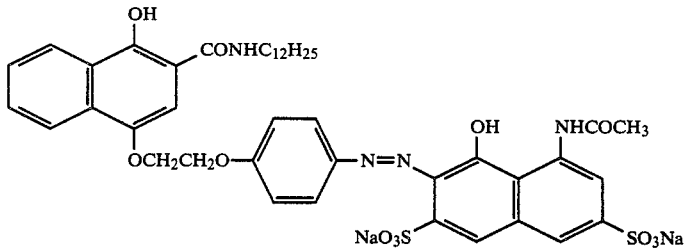

-continued
EX-4
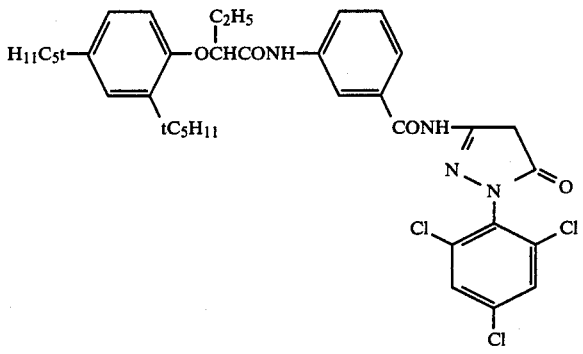
EX-5
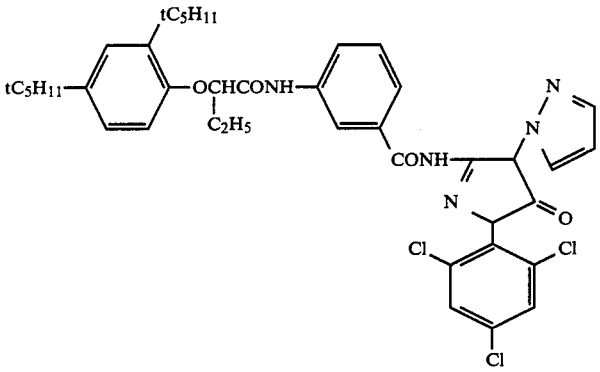
EX-6
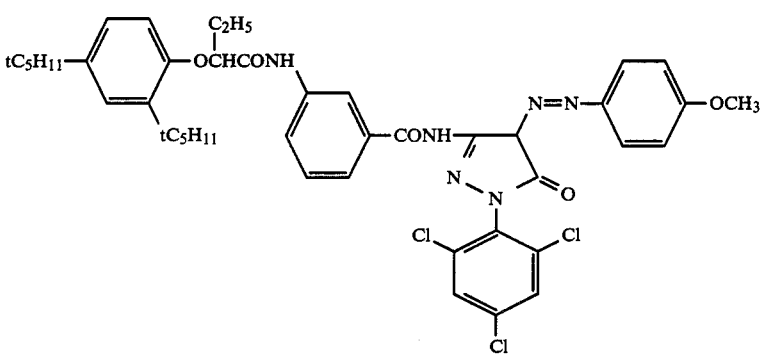
EX-7
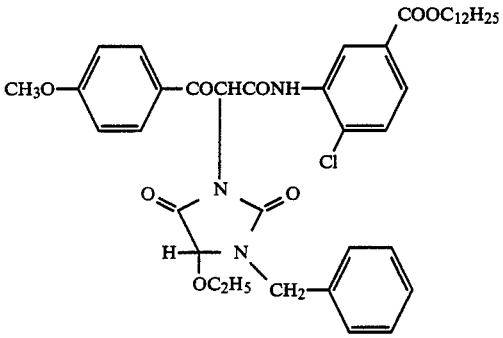

-continued
EX-8
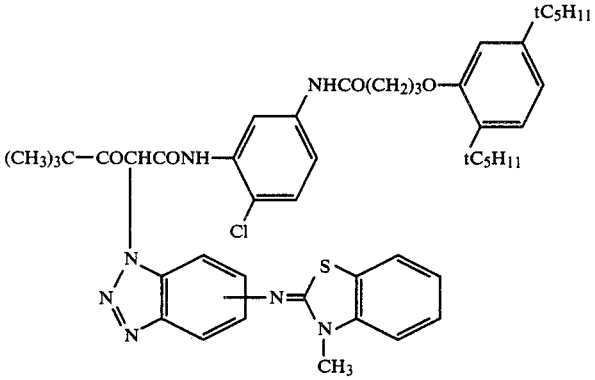
H-1
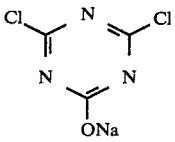
Sensitizing Dye I
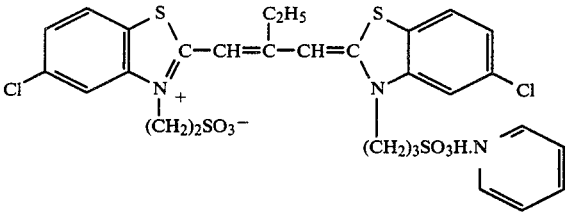
Sensitizing Dye II
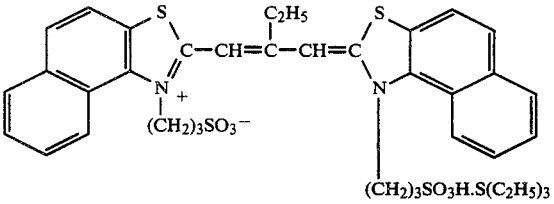
Sensitizing Dye III
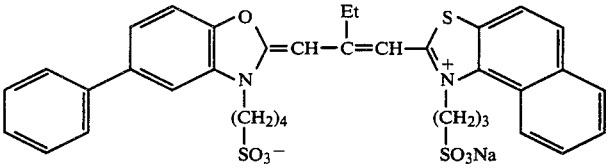
Sensitizing Dye V
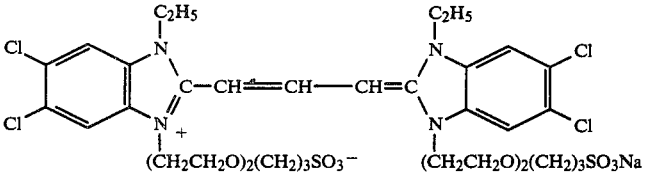
Sensitizing Dye IV
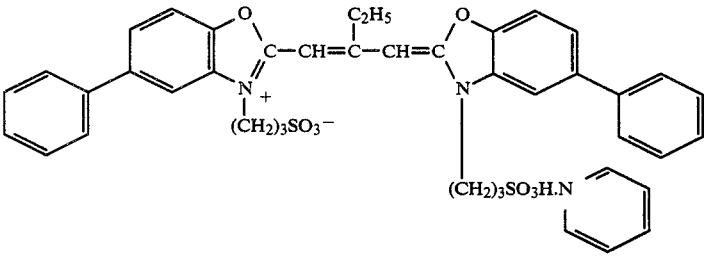

Sample 102

Sample 102 was prepared by following the same procedure as the case of preparing Sample 101 except that the amount of Coupler D-33 in Layer 6 was reduced to ½ thereof and Coupler EX-8 was added to the layer in an amount of 0.001 mole per mole of silver, and Coupler EX-8 was added to Layer 3 in an amount of 0.0005 mole per mole of silver.

Sample 103

Sample 103 was prepared by following the same procedure as the case of preparing Sample 101 except that the amount of Coupler D-33 in Layer 9 was reduced to ½ thereof and Coupler EX-8 was added to the layer in an amount of 0.005 mole per mole of silver, and Coupler EX-8 was added to Layer 3 in an amount of 0.0005 mole per mole of silver.

Sample 104

Sample 104 was prepared by following the same procedure as the case of preparing Sample 101 except that Sensitizing Dye III was removed from Layer 3, the amounts of Sensitizing Dyes I and II in Layer 3 were increased to 2.6 times, Sensitizing Dye III was removed from Layer 4, and the amounts of Sensitizing Dyes I and II in Layer 4 were increased to 2.6 times.

Sample 105

Sample 105 was prepared by following the same procedure as the case of preparing Sample 101 except that the amount of Sensitizing Dye I in Layer 3 was decreased to 0.6 times, the amount of Sensitizing Dye II in Layer 3 was increased to 4.7 times, the amount of Sensitizing Dye I in Layer 4 was reduced to 0.6 times, and the amount of Sensitizing Dye II in Layer 4 was increased to 4.2 times.

Sample 106

Sample 106 was prepared by following the same procedure as the case of preparing Sample 101 except that Sensitizing Dye II in Layer 3 was removed, the amount of Sensitizing Dye I in Layer 3 was increased to 1.1 times, Sensitizing Dye II in Layer 4 was removed, and the amount of Sensitizing Dye I in Layer 4 was increased to 1.1 times.

Sample 107

Sample 107 was prepared by following the same procedure as the case of preparing Sample 101 except that the amount of Sensitizing Dye III in Layer 3 was increased to 2.5 times, the amount of Sensitizing Dye I in Layer 3 was reduced to 0.29 times, the amount of Sensitizing Dye III in Layer 4 was increased to 2.5 times, and the amount of Sensitizing Dye I in Layer 4 was decreased to 0.27 times.

Sample 108

Sample 108 was prepared by following the same procedure as the case of preparing Sample 101 except that the amount of Sensitizing Dye III in Layer 3 was decreased to 0.5 times, the amount of Sensitizing Dye in Layer 3 was increased to 1.7 times, the amount of Sensitizing Dye III in Layer 4 was decreased to 0.5 times, and the amount of Sensitizing Dye I in Layer 4 was increased to 1.7 times.

Sample 109

Sample 109 was prepared by following the same procedure as the case of preparing Sample 101 except that the amount of Sensitizing Dye III in Layer 3 was reduced to 0.6 times, the amount of Sensitizing Dye II in Layer 3 was increased to 2 times, the amount of Sensitizing Dye III in Layer 4 was decreased to 0.6 times, and the amount of Sensitizing Dye II in Layer 4 was increased to 1.9 times.

After stepwise exposing each of Samples 101 to 109 thus prepared with green light, the sample was uniformly exposed to red light and processed by the following processing steps at 38° C.

1. Color Development: 3 min. 15 sec.
2. Bleach: 6 min. 30 sec.
3. Wash: 3 min. 15 sec.
4. Fix: 6 min. 30 sec.
5. Wash: 3 min. 15 sec.
6. Stabilization: 3 min. 15 sec.

The compositions of the processing solutions used for the above steps were as follows:

| | |
|---|---|
| Color Developer: | |
| Sodium Nitrotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methyl-aniline Sulfate | 4.5 g |
| Water to make | 1 liter |
| Bleach Solution: | |
| Ammonium Bromide | 160.0 g |
| Aqueous Ammonia (28%) | 25.0 ml |
| Ethylenediaminetetraacetic Acid Sodium Iron Salt | 130 g |
| Glacial Acetic Acid | 14 ml |
| Water to make | 1 liter |
| Fix Solution: | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 liter |
| Stabilization Solution: | |
| Formalin (37% formaldehyde solution) | 8.0 ml |
| Water to make | 1 liter |

The red light transmission density and the green light transmission density of each of Samples 101 to 109 thus processed were measured, and magenta images having characteristic curves as shown in FIG. 1 were obtained.

In the graph shown in FIG. 1, Δx shows the extent of an interlayer effect, by which the uniformly fogged cyan emulsion layer is restrained when the green-sensitive emulsion layer is developed from the unexposed portion (Point A) to the exposed portion (Point B).

That is, in FIG. 1, curve A-B shows a characteristic curve relative to the magenta image of the green-sensitive emulsion layer and curve a-b shows a cyan image density of the red-sensitive emulsion layer by red exposure. Also, Point A shows a fogged portion of the magenta image and Point B shows the exposed portion of giving a magenta image density of 1.5.

The difference (a−b) between the cyan density (a) at exposure amount A and the cyan density (b) at exposure amount B is the scale of the interlayer effect from the green-sensitive emulsion layer to the red-sensitive emulsion layer.

By following similar procedure as above, the interlayer effect from the blue-sensitive emulsion layer to the red-sensitive emulsion layer was obtained about Samples 101 to 109.

Then, using each of Samples 101 to 109, a color chart composed of red and grey was photographed. The photographing was performed in such a manner that the red portion was divided into two portions, the intensity of illumination at the one portion being high and that at the other portion being ⅓ of the former intensity, whereby a shade was formed on the red portion.

The samples were processed according to the above-described processing steps and each of the color negatives thus obtained was contact-printed to a color paper.

In this case, each negative was printed so that each density of cyan, magenta, and yellow of the grey-exposed portion of each of Samples 101 to 109 matched with the grey of the original. Then, the cyan density of the red chart exposed portion of the print thus obtained was measured.

The cyan density of the portion corresponding to the red chart portion at the high intensity of illumination at red chart photographing was shown by C, the cyan density of the portion corresponding to the red chart portion at low intensity of illumination was shown by D, and the values of C and D are shown in Table 2.

Figure 2:
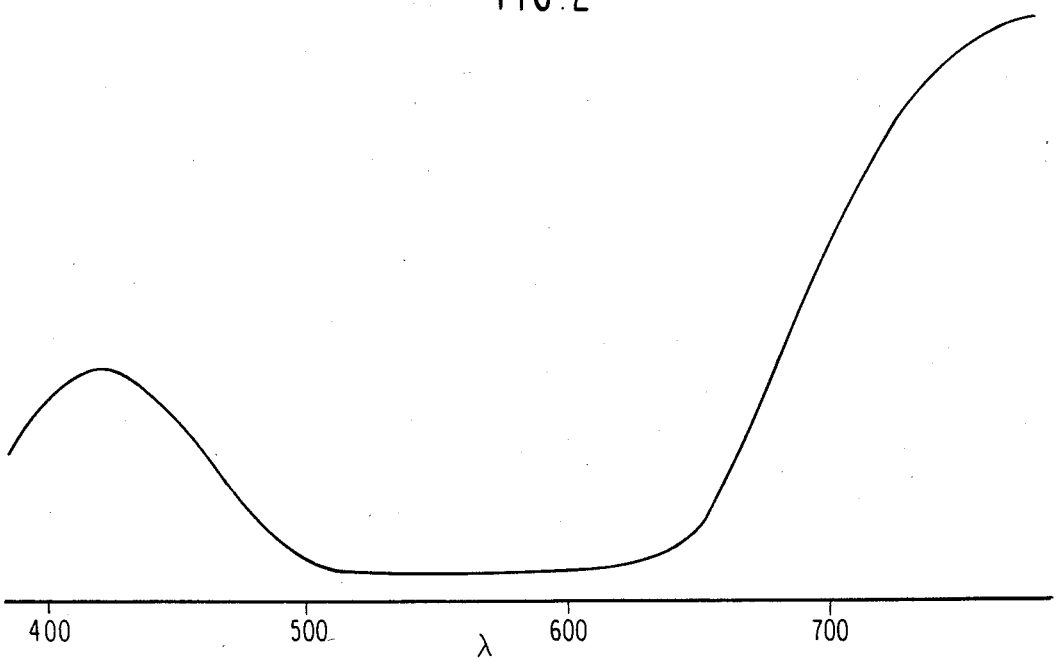
FIG. 2 is a graph showing a reflection spectrum of a cloth used for photographing in the example of this invention.

Then, using each of Samples 101 to 109 and also using a still camera, grey and a purple cloth having the reflection spectrum as shown in FIG. 2 were photographed, and the samples were subjected to the processing steps for color negative film. The color negatives thus obtained were printed so that the cyan, magenta and yellow densities of the grey portion of each negative were matched to grey of the original.

The cyan, magenta and yellow densities for the purple cloth on each print were measured and were compared with the those of the original cloth. The results thus obtained are shown in Table 2.

TABLE 2

| Sample No. | Cyan Density of Image of Red Chart on Paper | | Density of Image of Purple Cloth on Paper | | |
|---|---|---|---|---|---|
| | C | D | Cyan Density | Magenta Density | Yellow Density |
| 101 | 0.26 | 0.60 | 1.23 | 1.63 | 1.00 |
| 102 | 0.40 | 0.63 | 1.33 | 1.63 | 0.98 |
| 103 | 0.42 | 0.62 | 1.27 | 1.62 | 0.99 |
| 104 | 0.27 | 0.30 | 1.06 | 1.63 | 0.99 |
| 105 | 0.28 | 0.37 | 1.09 | 1.60 | 0.97 |
| 106 | 0.37 | 0.68 | 1.35 | 1.63 | 0.99 |
| 107 | 0.36 | 0.67 | 1.33 | 1.60 | 0.98 |
| 108 | 0.28 | 0.42 | 1.12 | 1.62 | 0.97 |
| 109 | 0.27 | 0.37 | 1.09 | 1.62 | 1.00 |
| Purple Cloth | — | — | 1.21 | 1.62 | 0.98 |

From the results shown in the above table, it can be seen that in Samples 102, 103, 106 and 107 (comparison samples), the portions of high intensity of illumination at red chart photographing show high cyan density and low red in saturation as compared to Sample 101 (the sample of this invention) although the extents in these comparison samples may differ to some extent. Also, in Samples 104, 105, 108, and 109 (comparison samples), the portions of the low intensity of illumination at red chart photographing show low cyan density and the shade by the difference in intensities of illumination is reluctant to be reproduced. This means that the reproduction of the shade of red is poor. Also, it can be seen that in the images by these comparison samples, the cyan density component of the purple cloth is less and the image corresponding to the purple cloth becomes reddish purple.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least a cyan-color-forming red-sensitive emulsion layer, a magenta-color-forming green-sensitive emulsion layer, and a yellow-color-forming blue-sensitive emulsion layer; the weight-averaged wavelength(λ) on the spectral sensitivity distribution determined by equi-energy spectrum of said red-sensitive emulsion layer being less than 640 nm; the

TABLE 1

| Sample No. | Interlayer Effect (Δx) | | Wave-Averaged Wave Length (nm) | A/B | Wavelength having Sensitivity of ½ of the Maximum Value of Spectral Sensitivity | |
|---|---|---|---|---|---|---|
| | Green-Sensitive Layer → Red-Sensitive Layer | Blue-Sensitive Layer → Red-Sensitive Layer | | | Longest Wave Length (nm) | Shortest Wave Length (nm) |
| 101 | 0.16 | 0.15 | 625 | 0.94 | 661 | 589 |
| 102 | 0.03 | 0.13 | 623 | 0.93 | 660 | 586 |
| 103 | 0.14 | 0.02 | 625 | 0.94 | 659 | 589 |
| 104 | 0.15 | 0.15 | 648 | 0.93 | 682 | 604 |
| 105 | 0.15 | 0.15 | 630 | 0.95 | 687 | 591 |
| 106 | 0.16 | 0.15 | 621 | 0.94 | 647 | 588 |
| 107 | 0.16 | 0.14 | 623 | 0.93 | 659 | 567 |
| 108 | 0.16 | 0.15 | 628 | 0.92 | 660 | 603 |
| 109 | 0.16 | 0.14 | 628 | 0.87 | 664 | 592 |

Sample 101: Sample of the invention
Samples 102-109: Comparison samples longest wavelength in the wavelengths having the sensitivity of ½ of the maximum value of the above-described equi-energy spectrum being in a range of from 30 nm to 55 nm longer than the weight-averaged wavelength and the minimum wavelength thereof being in a range of from 30 nm to 55 nm shorter than the weight-averaged wavelength; in the above-described equi-energy spectrum, values A and B defined below satisfying the relation of $A/B \geqq 0.91$; and further the sum of the interlayer effects on the red-sensitive emulsion layer from the green-sensitive emulsion layer and the blue-sensitive emulsion layer being more than 0.25

$$A = \int_{\lambda_1}^{\bar{\lambda}} S(\lambda)d\lambda$$

$$B = \int_{\bar{\lambda}}^{\lambda_2} S(\lambda)d\lambda$$

wherein, $S(\lambda)$ is the spectral sensitivity, $\lambda_1$ is the wavelength of the short wavelength end, and $\lambda_2$ is the wavelength of the long wavelength end.

2. A silver halide color photographic material as in claim 1, wherein the weight-averaged wavelength ($\lambda$) is from 605 nm to 630 nm.

3. A silver halide color photographic material as in claim 1, wherein the relation of $A/B \geqq 0.95$.

4. A silver halide color photographic material as in claim 2, wherein the relation of $A/B \geqq 0.95$.

5. A silver halide color photographic material as in claim 1, wherein at least one of said emulsion layer contains a diffusible DIR compound.

6. A silver halide color photographic material as in claim 5, wherein the magnitude of diffusibility is higher than 0.4.

7. A silver halide color photographic material as in claim 5, wherein said DIR compound is a DIR coupler.

8. A silver halide color photographic material as in claim 6, wherein said DIR compound in a DIR coupler.

9. A silver halide color photographic material as in claim 5, wherein the amount of the diffusible DIR compound is from 0.00001 to 0.002 mole/$m^2$.

10. A silver halide color photographic material as in claim 6, wherein the amount of the diffusible DIR compound is from 0.00001 to 0.002 mole/$m^2$.

11. A silver halide color photographic material as in claim 7, wherein the amount of the diffusible DIR coupler is from 0.00001 to 0.002 mole/$m^2$.

12. A silver halide color photographic material as in claim 8, wherein the amount of the diffusible DIR coupler is from 0.00001 to 0.002 mole/$m^2$.

13. A silver halide color photographic material as in claim 5, wherein the amount of the diffusible DIR compound is from 0.00002 to 0.001 mole/$m^2$.

14. A silver halide color photographic material as in claim 6, wherein the amount of the diffusible DIR compound is from 0.00002 to 0.001 mole/$m^2$.

15. A silver halide color photographic material as in claim 7, wherein the amount of the diffusible DIR coupler is from 0.00002 to 0.001 mole/$m^2$.

16. A silver halide color photographic material as in claim 8, wherein the amount of the diffusible DIR coupler is from 0.00002 to 0.001 mole/$m^2$.

* * * * *